US011376852B2

(12) United States Patent
Kimura et al.

(10) Patent No.: US 11,376,852 B2
(45) Date of Patent: Jul. 5, 2022

(54) LIQUID EJECTION APPARATUS

(71) Applicant: SEIKO EPSON CORPORATION, Tokyo (JP)

(72) Inventors: Naomi Kimura, Okaya (JP); Makoto Sawadaishi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 30 days.

(21) Appl. No.: 16/928,261

(22) Filed: Jul. 14, 2020

(65) Prior Publication Data

US 2021/0016573 A1 Jan. 21, 2021

(30) Foreign Application Priority Data

Jul. 16, 2019 (JP) ..... JP2019-130972

(51) Int. Cl.
*B41J 2/165* (2006.01)
*B41J 25/304* (2006.01)

(52) U.S. Cl.
CPC ..... *B41J 2/16517* (2013.01); *B41J 25/304* (2013.01)

(58) Field of Classification Search
CPC ..... B41J 2/16517; B41J 25/304
See application file for complete search history.

(56) References Cited

U.S. PATENT DOCUMENTS

2018/0009227 A1* 1/2018 Izawa ..... B41J 2/17513
2018/0272731 A1 9/2018 Kimura et al.
2019/0092037 A1* 3/2019 Murata ..... B41J 2/16523

FOREIGN PATENT DOCUMENTS

JP 2018-161851 10/2018

* cited by examiner

*Primary Examiner* — Sharon Polk
(74) *Attorney, Agent, or Firm* — Workman Nydegger

(57) ABSTRACT

A liquid ejection apparatus includes a liquid ejection head that ejects liquid to a medium transported in a transport direction on a transport path, a liquid container that includes a containing chamber for containing liquid to be supplied to the liquid ejection head and an inlet for pouring the liquid into the containing chamber, a carriage movable in a scanning direction that intersects the transport direction in a state where the liquid ejection head and the liquid container loaded on the carriage, and a mounting portion on which a waste liquid container that contains liquid as waste liquid discharged from the liquid ejection head is detachably mounted. When the liquid ejection head is located outside the transport path in the scanning direction, the carriage is disposed at a position that overlaps the mounting portion in the vertical direction.

7 Claims, 17 Drawing Sheets

LIQUID EJECTION APPARATUS

The present application is based on, and claims priority from JP Application Serial Number 2019-130972, filed Jul. 16, 2019, the disclosure of which is hereby incorporated by reference herein in its entirety.

BACKGROUND

1. Technical Field

The present disclosure relates to a liquid ejection apparatus that ejects liquid.

2. Related Art

In a liquid ejection apparatus, a reduction in a size of an apparatus body is required from the viewpoint of responding to various installation places. In particular, there is a demand for a casing that occupies a small area when the liquid ejection apparatus is installed on a desk or floor.

JP-A-2018-161851 discloses a recording apparatus as an example of a liquid ejection apparatus that ejects liquid onto a medium such as paper while a carriage including a recording head as an example of a liquid ejection head moves. The carriage is provided with an ink tank as an example of a liquid container that contains ink to be supplied to the recording head. The ink tank includes a remaining amount checking section formed of a transparent material that allows a remaining amount of liquid inside thereof to be visually recognized, and a visual recognition section that allows the remaining amount checking section of the ink tank to be visually recognized is provided on a side surface on the apparatus front side of the carriage.

The liquid ejection apparatus includes a maintenance device that performs maintenance for discharging liquid from nozzles of the liquid ejection head for the purpose of, for example, eliminating clogging of the nozzles of the liquid ejection head. Usually, a liquid ejection apparatus is mounted with a waste liquid container that contains liquid discharged from the liquid ejection head as waste liquid.

However, in the liquid ejection apparatus described in JP-A-2018-161851, a mounting area of the apparatus may increase due to layout of components in a casing depending on the position where the waste liquid container is mounted in the casing. On the other hand, if a component layout that avoids an increase in the mounting area of the apparatus is adopted, operability when attaching and detaching the waste liquid container to and from the casing may be deteriorated.

SUMMARY

According to an aspect of the present disclosure, there is provided a liquid ejection apparatus including a liquid ejection head that ejects liquid to a medium transported in a transport direction on a transport path, a liquid container that includes a containing chamber for containing liquid to be supplied to the liquid ejection head and an inlet for pouring the liquid into the containing chamber, a carriage movable in a scanning direction that intersects the transport direction in a state where the liquid ejection head and the liquid container are loaded on the carriage, and a mounting portion on which a waste liquid container that contains liquid as waste liquid discharged from the liquid ejection head is detachably mounted, in which the mounting portion is provided in a region on a front side in the transport direction of the liquid ejection apparatus and when the liquid ejection head is located outside the transport path in the scanning direction, the carriage is disposed at a position that overlaps the mounting portion in a vertical direction. The expression "overlapping the mounting portion in the vertical direction" includes a case where the carriage overlaps the entire mounting portion and a case where the carriage overlaps only a part of the mounting portion.

DESCRIPTION OF EXEMPLARY EMBODIMENTS

Hereinafter, an embodiment of a liquid ejection apparatus will be described with reference to the accompanying drawings. In the XYZ coordinate system illustrated in each figure, the X-axis indicates an apparatus width direction, the Y-axis indicates an apparatus depth direction, and the Z-axis indicates an apparatus height direction. The +Y-direction is defined as the front of the apparatus, and the −Y-direction is defined as the rear of the apparatus. The +X-direction, which is the left when viewed from the front of the apparatus, is defined as the left side of the apparatus, and the −X-direction, which is the right when viewed from the front of the apparatus, is defined as the right side of the apparatus. The +Z-direction is defined as the upper side, and the −Z-direction side is defined as the lower side. The −Z-direction is also referred to as the vertical direction. The direction when passing through a recording area where recording is performed on the medium is the +Y-direction, which is also referred to as a transport direction.

First Embodiment

Hereinafter, a first embodiment of a liquid ejection apparatus will be described with reference to the accompanying drawings.

Overview of Liquid Ejection Apparatus

Figure 1:
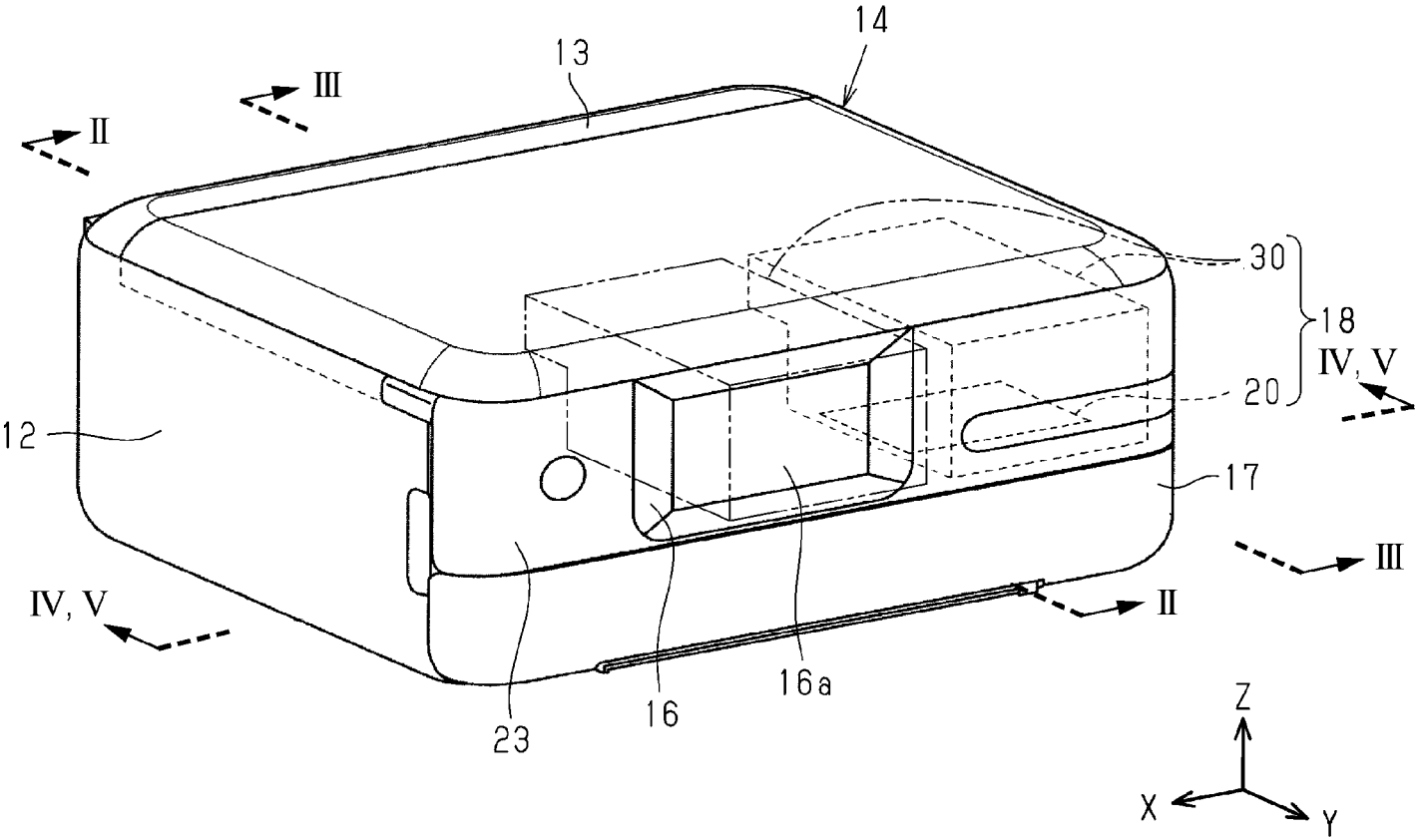
FIG. 1 is a perspective view illustrating an appearance of a liquid ejection apparatus according to a first embodiment.

As illustrated in FIG. 1, a liquid ejection apparatus 11 includes a casing 12 including a recording section 18 for performing recording on a medium therein, and a scanner unit 14 provided on an upper part of the casing 12 and reading an image of a document. The liquid ejection apparatus 11 is configured as a multifunction peripheral having an image reading function in addition to a recording function.

Examples of the medium on which recording is performed include thick paper such as postcards and business cards thicker than plain paper, thin paper thinner than plain paper, and glossy paper for photographs, and the like, in addition to plain paper. The liquid ejection apparatus 11 is also configured to be able to record on a label surface of a disk-type memory such as a CD or DVD.

The recording section 18 includes a liquid ejection head 20 that ejects ink as an example of liquid and a carriage 30 on which the liquid ejection head 20 is loaded, and performs recording by ejecting ink from the liquid ejection head 20 toward a medium P.

As illustrated in FIG. 1, a panel unit 23 including an operation section 16 is provided in front of the apparatus of the liquid ejection apparatus 11. The user performs various setting operations and execution operations of the liquid ejection apparatus 11 by using an operation section 16. On a panel unit 23, an operation surface 16*a* for displaying setting contents and operation status of the liquid ejection apparatus 11, preview of an image, and the like is disposed.

About Transport Path

Figure 2:
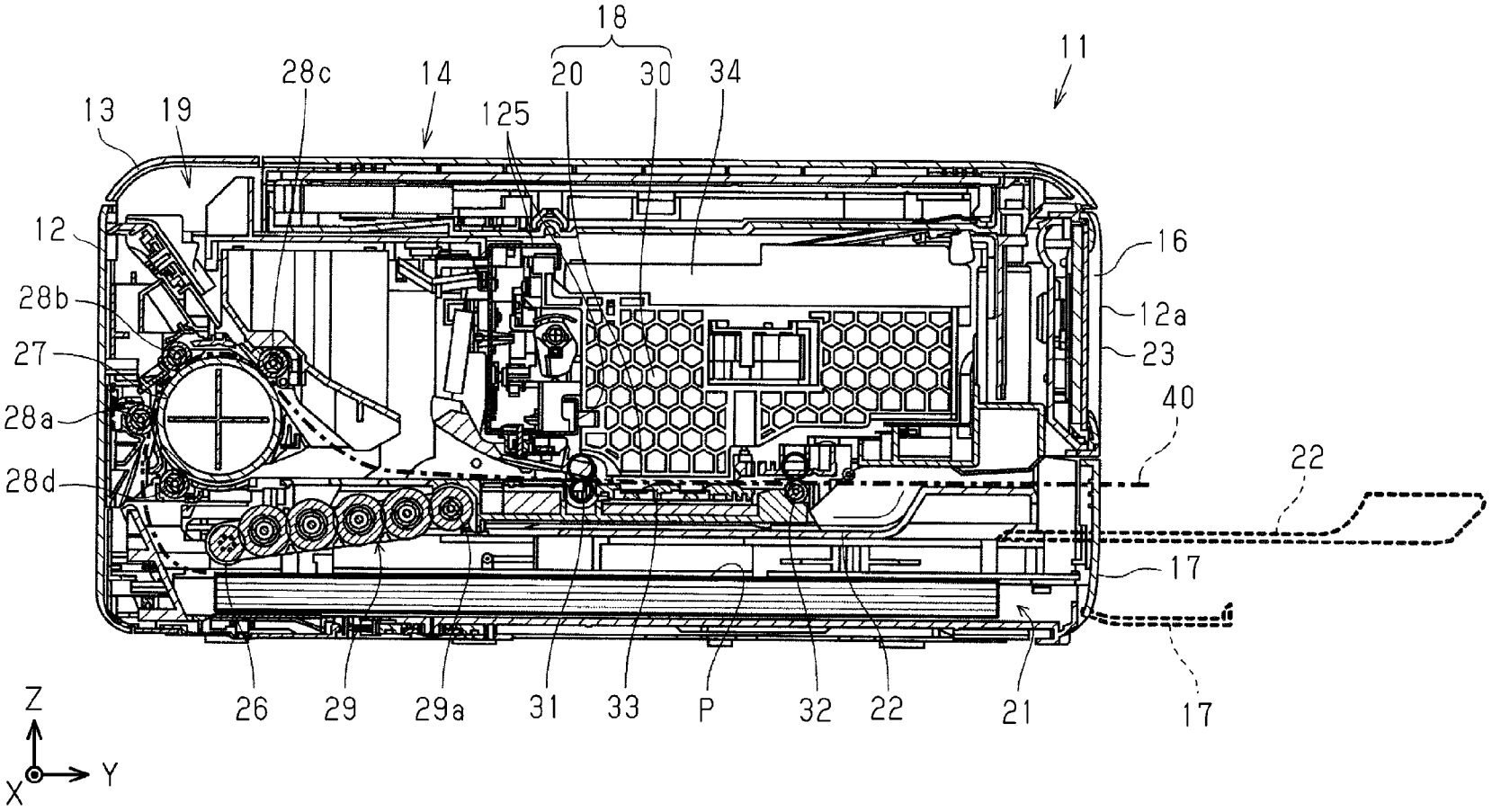
FIG. 2 is a side cross-sectional view taken along line II-II in FIG. 1.

As illustrated in FIG. 2, a lower cover 17 is provided below a front surface 12*a* of a casing 12. By opening the lower cover 17 as illustrated by a broken line in FIG. 2, a medium tray 21 for storing the medium P before recording and a discharge tray 22 for receiving the medium P discharged after recording are exposed.

The discharge tray 22 is configured to be switchable between an accommodated state accommodated in the casing 12 indicated by a solid line in FIG. 2 and a protruding state in which the casing 12 protrudes to the front of the apparatus) as indicated by the broken line in FIG. 2, and stores the recorded medium in the protruding state.

As illustrated in FIG. 2, the medium tray 21 is capable of storing a plurality of media P, and is attachable and detachable to and from the casing 12. The medium tray 21 sends out the medium P to a transport path 40 indicated by one-dot chain line in FIG. 2 in a state of being mounted to the casing 12. The user replenishes the medium P in a state where the medium tray 21 is pulled out forward. The transport path 40 is a path through which the medium P fed from the medium tray 21 provided at the lower part of the liquid ejection apparatus 11 passes through the recording area of the recording section 18 and is discharged to the discharge tray 22. The transport direction in this embodiment is a direction (+Y-direction) in which the medium passes through the recording area of the recording section 18.

The medium P set on the medium tray 21 is picked up by a feed roller 26 and sent out to the transport path 40. The feed roller 26, which is rotationally driven by a driving source (not illustrated), is provided on a roller support member 29 that swings around a swing shaft 29*a*, and rotates in contact with the uppermost one of a plurality of media P stored in the medium tray 21 to send out the uppermost medium P from the medium tray 21 to the rear of the apparatus.

As illustrated in FIG. 2, an intermediate roller 27 that is rotationally driven by a driving source (not illustrated) is provided downstream of the feed roller 26. The medium P is curved and inverted by the intermediate roller 27 and sent to the front of the apparatus. Driven rollers 28*a*, 28*b*, 28*c*, and 28*d* are driven and rotated by the intermediate roller 27. The medium P is nipped by the driven roller 28*a* and the intermediate roller 27, subsequently nipped by the driven roller 28*b* and the intermediate roller 27, further nipped by the driven roller 28*c* and the intermediate roller 27, and sent downstream. The driven roller 28*d* will be described later.

A transport roller pair 31 is provided downstream of the intermediate roller 27, and the medium P is sent below the liquid ejection head 20 by the transport roller pair 31. In the transport roller pair 31, a lower roller is rotationally driven by a driving source (not illustrated), and an upper roller is driven to rotate when the lower roller is rotated.

As illustrated in FIG. 2, the recording section 18 is provided downstream of the transport roller pair 31. In the recording section 18, the liquid ejection head 20 that ejects ink is provided on the bottom of the carriage 30.

At a position facing the liquid ejection head 20, a medium support member 33 that supports the medium P transported in the transport path 40 is provided, and a distance between the medium P and the liquid ejection head 20 is prescribed by the medium support member 33.

The transport roller pair 31 transports the medium P onto the medium support member 33 along the transport direction. Then, the liquid ejection head 20 performs recording by ejecting liquid onto the medium P supported by the medium support member 33 and transported on the transport path 40 in the transport direction. In this embodiment, the recording area is an area where recording is performed by ejecting liquid onto the medium P by the liquid ejection head 20.

As illustrated in FIG. 2, a discharge roller pair 32 is provided downstream of the medium support member 33. Also, in the discharge roller pair 32, similarly to the transport roller pair 31, a lower roller is rotationally driven by a driving source (not shown), and an upper roller is driven to rotate when the lower roller is rotated. The recorded medium P is discharged by the discharge roller pair 32 toward the discharge tray 22 which is in the protruding state illustrated by a broken line in FIG. 2.

The liquid ejection apparatus 11 is configured to be able to perform double-sided recording in which recording is performed on a first surface of the medium P and a second surface opposite to the first surface. When double-sided recording is performed, the medium P is switched back and sent to the rear of the apparatus after recording on the first surface. The medium P that has been switched back is nipped by the driven roller 28*d* and the intermediate roller 27 and is joined to the transport path 40. The medium P is reversed by the intermediate roller 27 and is transported below the liquid ejection head 20 in a state where the second surface faces the liquid ejection head 20, and recording on the second surface is performed.

The liquid ejection apparatus 11 is configured to be able to supply the medium P on which recording is performed from a supply port 19 provided at the upper part of the rear of the apparatus. The supply port 19 is opened by opening a supply port cover 13. The medium P supplied from the supply port 19 enters the transport path 40 from upstream of the transport roller pair 31. The liquid ejection head 20 ejects liquid onto the medium P that is transported on the transport path 40 in the transport direction.

About Carriage Movement

Figure 3:
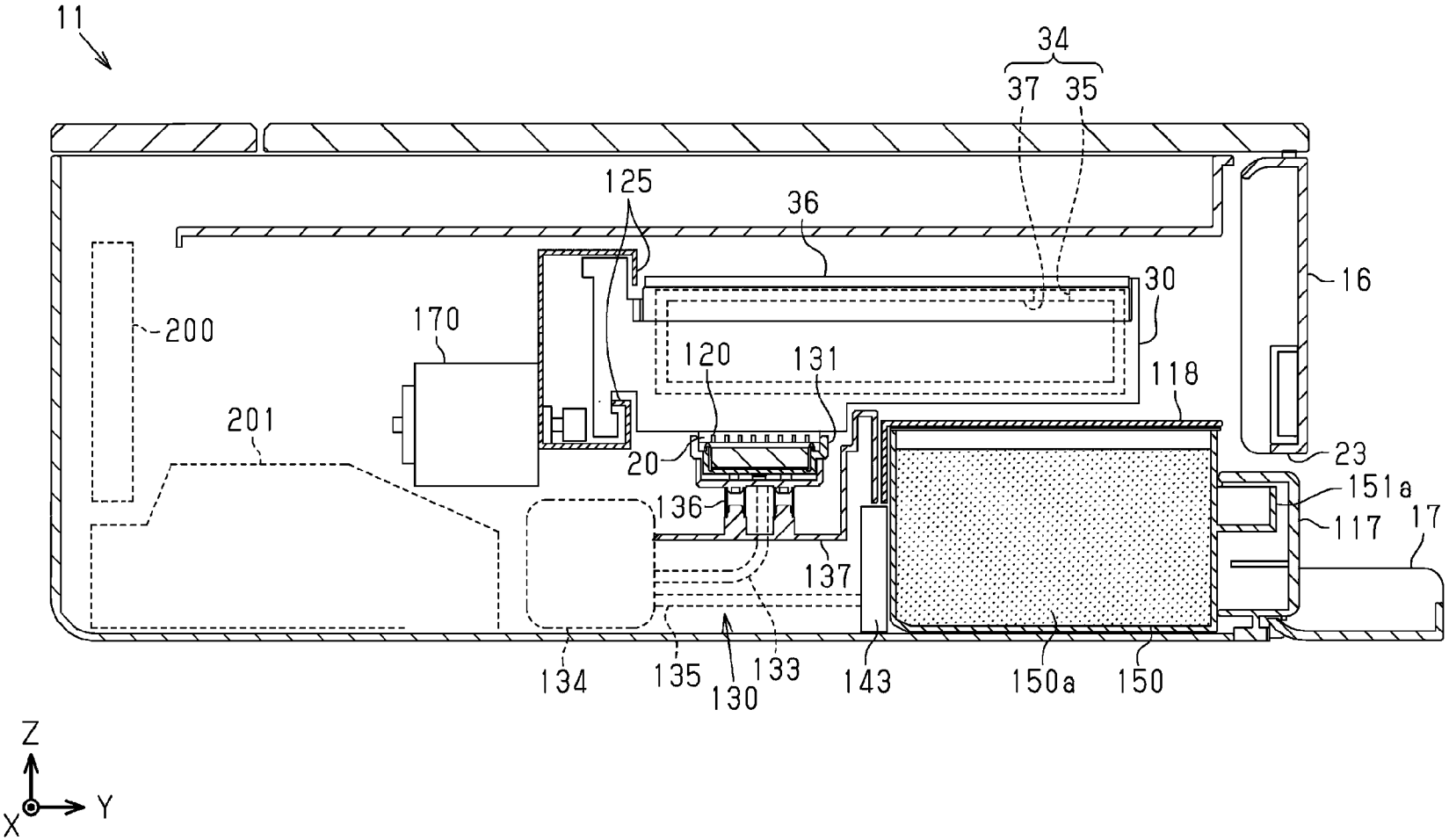
FIG. 3 is a side cross-sectional view taken along line in FIG. 1.

As illustrated in FIG. 3, the liquid ejection apparatus 11 includes the carriage 30 on which the liquid ejection head 20 is loaded and reciprocated in the apparatus width direction, a guide plate 125 extending in a moving direction of the carriage 30, a carriage motor 170 for reciprocating the carriage 30, and a control section 200 that controls driving of the carriage motor 170. A direction in which the carriage 30 moves is referred to as a scanning direction.

In this embodiment, the scanning direction and the apparatus width direction are the same direction, and the transport direction (+Y-direction) is the same direction as the apparatus depth direction. The scanning direction and the transport direction intersect (are orthogonal in this embodiment p). The carriage 30 is movable in the scanning direction in a state where the liquid ejection head 20 and a liquid container 34 containing liquid to be ejected by the liquid ejection head 20 are mounted to the carriage 30. The liquid ejection apparatus 11 of this embodiment employs an ink pouring method in which a user pours ink from a liquid replenishing container into the liquid container 34 mounted to the carriage 30. The liquid replenishing container is, for example, an ink supply bottle containing ink.

Figure 4:
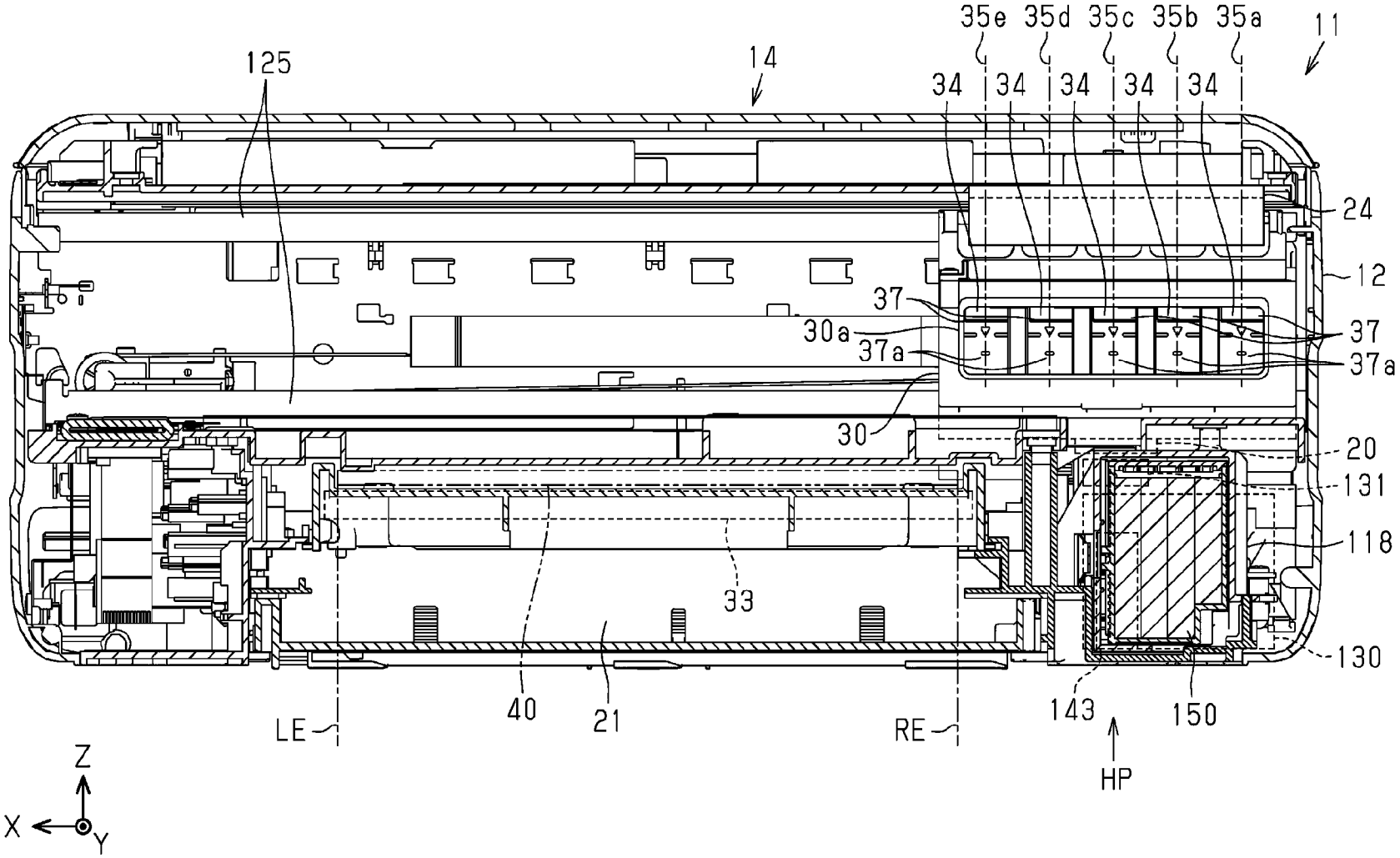
FIG. 4 is a front cross-sectional view taken along line IV-IV in FIG. 1 in a state where a carriage has moved to a home position.
Figure 6:
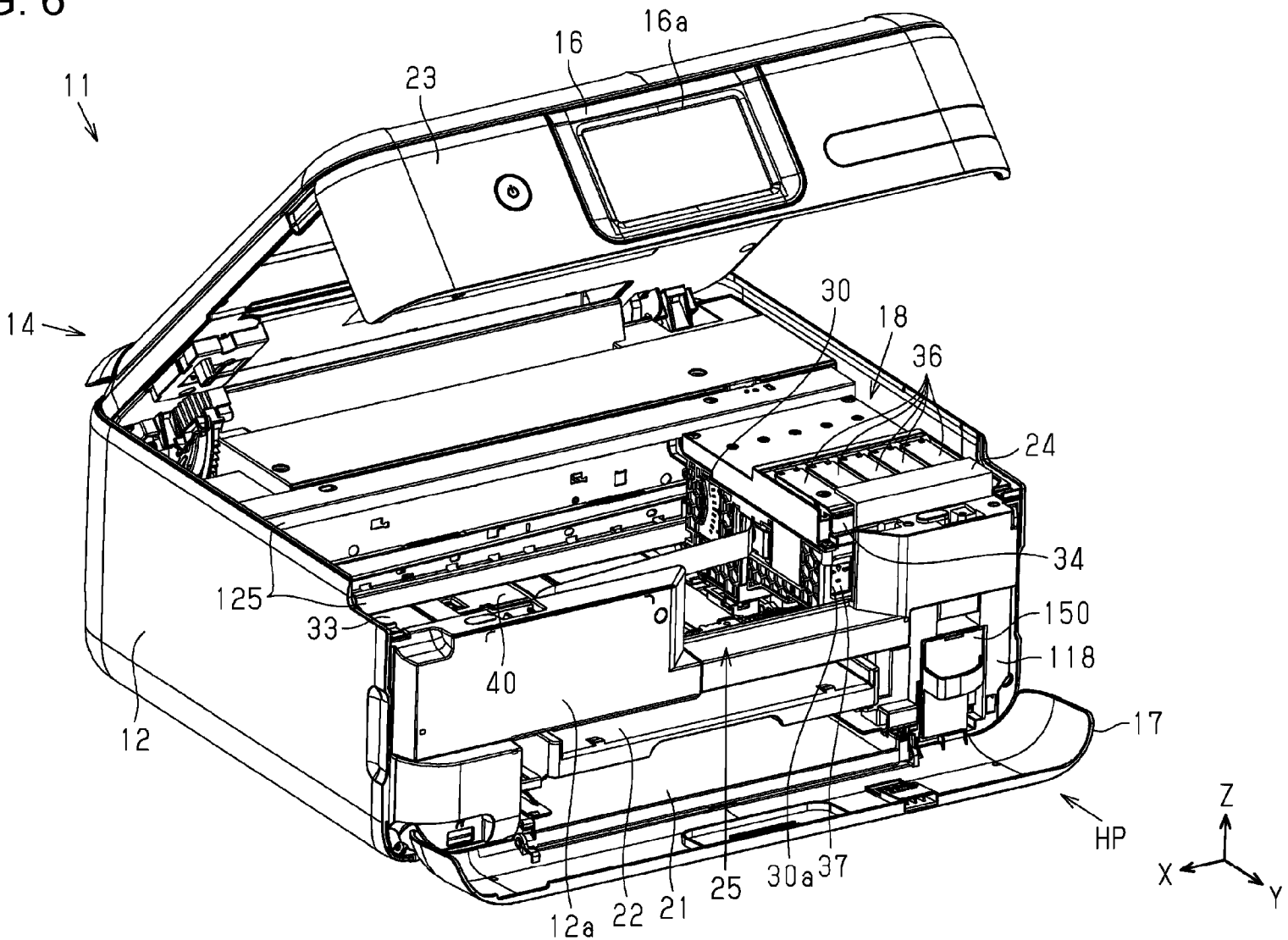
FIG. 6 is a perspective view illustrating a state where the carriage has moved to a home position.

As illustrated in FIGS. 4 and 6, a position where the carriage 30 waits (the position in FIGS. 4 and 6) before the liquid ejection head 20 starts printing on the medium P is referred to as a home position HP. At the home position HP, capping and a maintenance operation are performed. The capping and maintenance operation will be described later. The home position HP is set at one end of a movement area of the carriage 30, and in this embodiment, is set at the end on the −X-direction side. The side on which the home position is present in the scanning direction is referred to as the home position HP side, and the side opposite to the home position HP is referred to as an opposite home position side.

Figure 5:
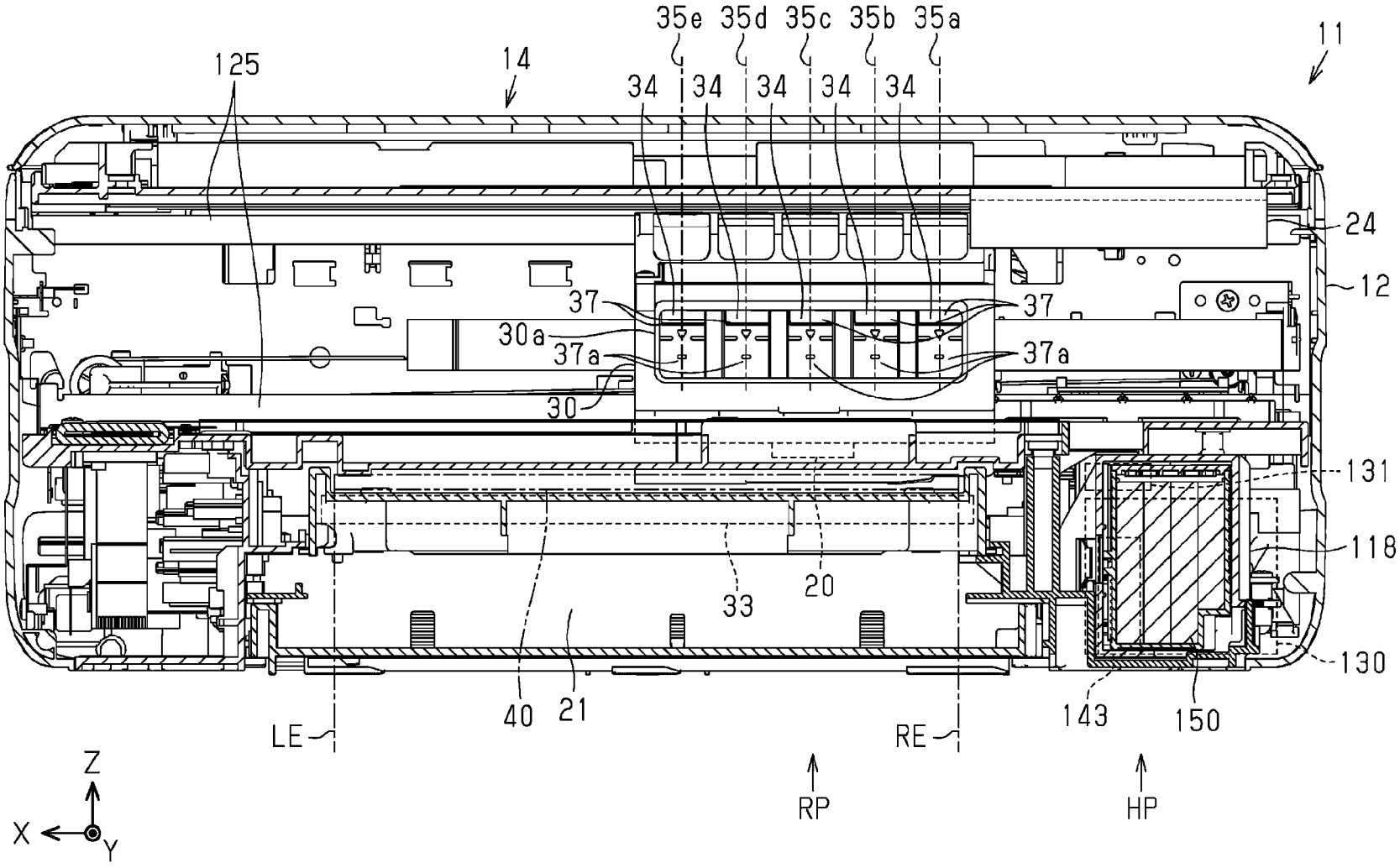
FIG. 5 is a front cross-sectional view taken along line V-V in FIG. 1 in a state where the carriage has moved to an ink pouring position.
Figure 7:
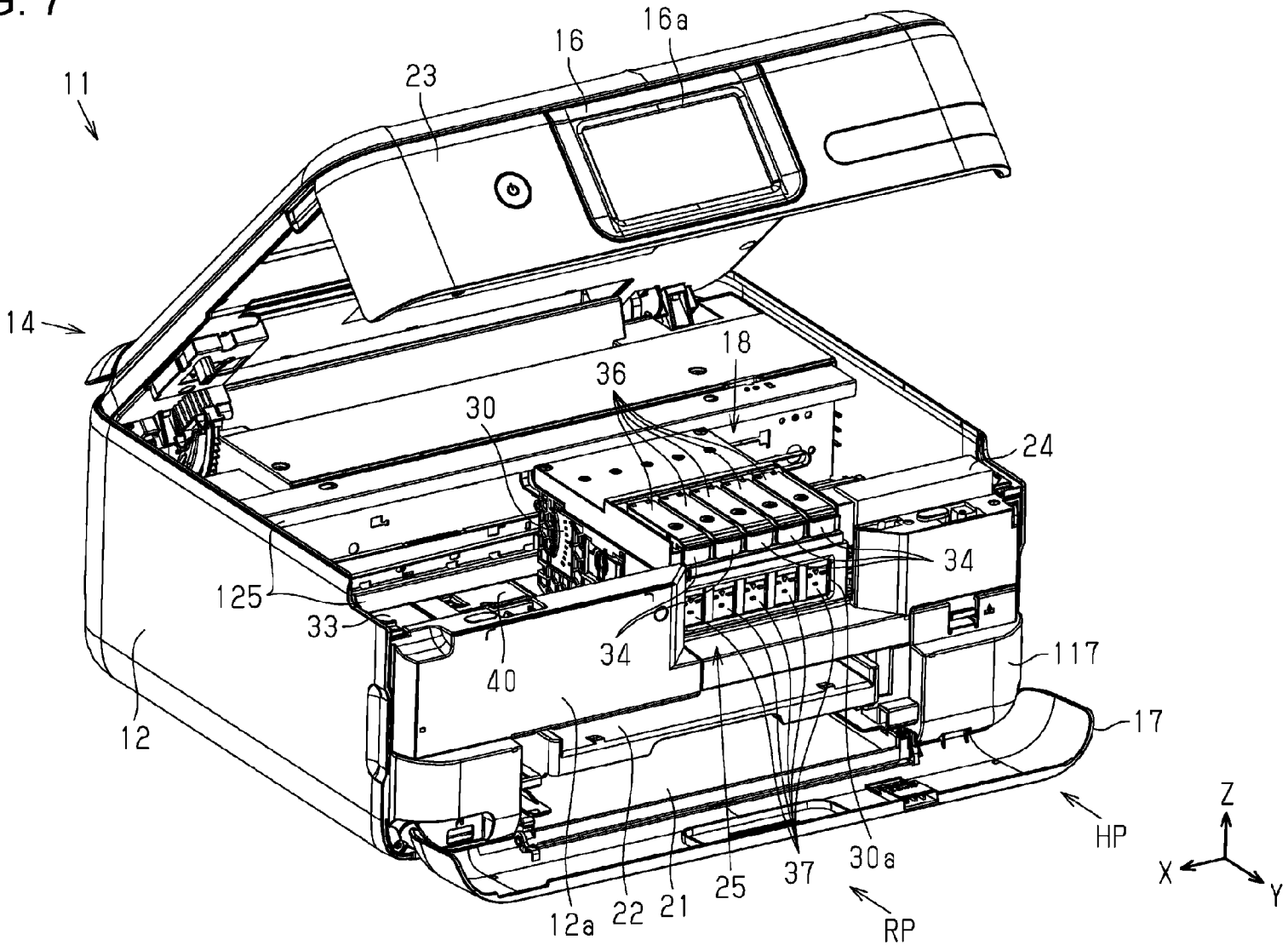
FIG. 7 is a perspective view illustrating a state where a carriage has moved to an ink pouring position.

As illustrated in FIGS. 5 and 7, when the ink reduced by performing the recording is poured, the carriage 30 waits at a predetermined position (the position in FIGS. 5 and 7). The liquid ejection apparatus 11 according to this embodiment is configured to be able to pour ink into the liquid container 34 (see FIG. 7) when the carriage 30 is at the predetermined position and the scanner unit 14 is in an open state. The pouring of ink will be described later.

About Maintenance Mechanism

As illustrated in FIG. 3, a maintenance mechanism 130 for maintaining the liquid ejection head 20 is accommodated in the casing 12. The liquid ejection apparatus 11 includes a control section 200 that controls operations of components including the liquid ejection head 20 and the maintenance mechanism 130 at a predetermined position in the casing 12.

The maintenance mechanism 130 is positioned to align with the medium support member 33 (see FIG. 2) along the scanning direction of the liquid ejection head 20. The maintenance mechanism 130 includes a cap 131 disposed at one end side in the scanning direction, a wiper (not illustrated) for wiping the liquid ejection head 20, and a suction pump 134 coupled to the cap 131 via a suction tube 133.

As illustrated in FIG. 3, the liquid ejection apparatus 11 includes a mounting portion 118 to which a waste liquid container 150 is detachably mounted. The maintenance mechanism 130 is positioned upstream of the mounting portion 118 in the transport direction. The suction pump 134 constituting the maintenance mechanism 130 is coupled to the mounting portion 118 through a discharge tube 135. That is, the suction pump 134 is coupled to the waste liquid container 150 mounted to the mounting portion 118 through the discharge tube 135. The cap 131 is supported by a support frame 137 in the casing 12 via an urging member 136. The cap 131 is configured to be movable by a moving mechanism (not illustrated) between an open position separated from the liquid ejection head 20 and a capping position (position illustrated in FIG. 3) surrounding a nozzle 120 and in contact with the liquid ejection head 20. The cap 131 present at the capping position is urged by the urging force of an urging member 136 in a direction in which the cap 131 is pressed against the liquid ejection head 20.

As illustrated in FIG. 3, the maintenance mechanism 130 performs a maintenance operation of the liquid ejection head 20 under control of the control section 200. The maintenance operation is an operation for preventing or eliminating an ejection failure of the liquid ejection head 20. For example, when a power supply 201 of the liquid ejection head 20 is turned off, the liquid ejection head 20 is disposed at the home position HP (see FIG. 4) where the cap 131 is present (the position illustrated in FIG. 3).

Then, the maintenance mechanism 130 moves the cap 131 to the capping position, and performs capping for forming a closed space surrounding the nozzle 120 between the liquid ejection head 20 and the cap 131. Due to the capping, there is little possibility that clogging due to drying of the ink in the nozzle 120 occurs.

As illustrated in FIG. 3, the maintenance mechanism 130 executes suction cleaning in which liquid in the liquid ejection head 20 is forced to flow out from the nozzle 120 by driving the suction pump 134 in a capping state. A configuration in which a pressurizing section is provided to pressurize the liquid in the liquid container 34 to execute pressurization cleaning in which the liquid flows out from the nozzle 120 may be adopted.

Cleaning including the suction cleaning and the pressurization cleaning may be performed at the time of initial filling when a flow path up to the nozzle 120 is filled with the liquid, or may be performed as a maintenance operation for eliminating the ejection failure by a user's operation when the ejection failure of liquid occurs due to clogging of the nozzle 120 or the like. Cleaning may be periodically performed every time a fixed time elapses. Cleaning may be performed when an ejection failure is detected by a nozzle inspection section that detects the presence or absence of the ejection failure due to clogging of the nozzle 120.

After the cleaning, the maintenance mechanism 130 moves the cap 131 to the open position, performs idle suction again to drive the suction pump 134 in a state where the inside of the cap 131 is opened to the atmosphere, and sucks waste liquid remaining in the cap 131. Then, the liquid that has flown out from the liquid ejection head 20 by the cleaning and the idle suction is stored in the waste liquid container 150 through the discharge tube 135 as waste liquid containing air bubbles, a solute component of the liquid increased in viscosity, and the like.

About Mounting Portion

As illustrated in FIG. 3, the lower cover 17 attached below the panel unit 23 on the apparatus front side of the liquid ejection apparatus 11 is disposed at a closed position (see FIG. 1) and an open position (see FIG. 3) by being rotated substantially 90 degrees around the lower end side.

As illustrated in FIG. 3, when the lower cover 17 is disposed at the open position, a containing body cover 117 detachably mounted to the casing 12 is exposed. The liquid ejection apparatus 11 includes the mounting portion 118. The containing body cover 117 covers an opening of the mounting portion 118 to which the waste liquid container 150 is detachably mounted. The containing body cover 117 has elasticity in the mounting direction, and presses the waste liquid container 150 in the mounting direction by its elastic force so that the inserted waste liquid container 150 does not fall out from the mounting portion 118. A substrate coupling portion 143 that is electrically coupled to a circuit substrate 156 (see FIG. 11) provided on the waste liquid container 150 inserted into the mounting portion 118 is provided on the depth side of the mounting portion 118. The containing body cover 117 may be configured to be fixed to the casing 12 with screws or the like.

As illustrated in FIG. 3, the waste liquid container 150 that stores liquid as waste liquid discharged from the liquid ejection head 20 is detachably mounted to the mounting portion 118 in front of the apparatus, which is downstream in the transport direction of the casing 12. Then, when the waste liquid container 150 is filled with waste liquid or the like, the waste liquid container 150 is taken out from the mounting portion 118 and replaced with a new one. An absorber 150*a* capable of absorbing waste liquid may be accommodated in the waste liquid container 150.

As illustrated in FIG. 3, since the substrate coupling portion 143 is positioned on the depth side of the mounting portion 118 which opens forward, the waste liquid container 150 is mounted to the mounting portion 118 as it moves rearward, and is removed from the mounting portion 118 as it moves forward. That is, the waste liquid container 150 is detachably mounted from the front of the apparatus, which is downstream in the transport direction of the casing 12. Here, the transport direction of the medium P is the direction in which the waste liquid container 150 is taken out from the mounting portion 118, and the direction opposite to the transport direction is the mounting direction in which the waste liquid container 150 is mounted to the mounting portion 118.

The direction in which the user removes the waste liquid container 150 from the mounting portion 118 is the transport direction. The direction in which the waste liquid container 150 is removed from the mounting portion 118 is parallel to the direction in which the discharge tray 22 extends, is the same as the direction in which the user pulls out the discharge tray 22 (see FIG. 2), and is the same as the direction in which the user pulls out the medium tray 21 when the user replenishes the medium tray 21 with the medium P.

About Position Relationship Between Mounting Portion, Maintenance Mechanism, Carriage, and Inlet As illustrated in FIG. 4, the medium tray 21 is disposed at the bottom of the center of the liquid ejection apparatus 11. In this embodiment, since the medium P fed from the medium tray 21 is transported on the transport path 40 in the transport direction, a storing range for the medium P having the maximum width stored in the medium tray 21 in the scanning direction is a range of the transport path 40. The transport path 40 is positioned on the medium support member 33 that supports the medium P to be transported. The transport path 40 is a range spanning from the +X side of the right end RE of the transport path 40 to the −X-direction side of the left end LE of the transport path 40. When a part of the carriage 30 deviates from the transport path 40 in the scanning direction, the carriage 30 is said to be outside the transport path 40 in the scanning direction.

The medium tray 21 and the discharge tray 22 (see FIG. 2) are disposed inside the transport path 40, and there is no space for disposing other components. For that reason, other components are disposed outside the transport path 40 in the scanning direction. In this embodiment, the maintenance mechanism 130 that performs the cleaning operation of the liquid ejection head 20 and the mounting portion 118 to which the waste liquid container 150 that contains liquid as waste liquid discharged from the liquid ejection head 20 is detachably mounted are disposed outside the transport path 40 in the scanning direction.

As illustrated in FIGS. 3 and 4, the mounting portion 118 is outside the transport path 40 in the scanning direction of the carriage 30 and on downstream in the transport direction inside the casing 12. In this embodiment, the mounting portion 118 is outside on the home position HP side in the transport path 40.

As illustrated in FIG. 3, in this embodiment, the following component layout is adopted in order to load the waste liquid container 150 detachably mounted to the liquid ejection apparatus 11. The liquid ejection head 20 is disposed on the apparatus rear side of the carriage 30, and the cap 131 is disposed directly below the liquid ejection head 20. By retracting the maintenance mechanism 130 in the casing 12 to the apparatus rear side while maintaining this position condition of the cap 131, a disposition space capable of accommodating the mounting portion 118 is secured in a downstream area in the transport direction inside the casing 12. By accommodating the mounting portion 118 in the disposition space, the mounting portion 118 is disposed in front of the apparatus.

That is, the liquid ejection head 20 is disposed at a position on the rear side at the bottom of the carriage 30. In the depth direction Y, a portion of the maintenance mechanism 130 downstream of the cap 131 extends longer than a portion of the maintenance mechanism 130 upstream of the cap 131. The suction pump 134 is disposed at a position upstream of the cap 131. In the depth direction Y, the downstream end of the maintenance mechanism 130 is positioned between the downstream end of the cap 131 and the downstream end of the carriage 30. The downstream end of the maintenance mechanism 130 is positioned closer to the downstream end of the cap 131 than the downstream end of the carriage 30. In the depth direction Y, the downstream end of the maintenance mechanism 130 is positioned at the same position as the center position of the length range of the carriage 30 or upstream of the carriage 30. Since the upstream end of the waste liquid container 150 is substantially adjacent to the downstream end of the maintenance mechanism 130, the position condition of the downstream end of the maintenance mechanism 130 described above is also the position condition of the upstream end of the waste liquid container 150.

For that reason, when the carriage 30 is at the home position HP, the disposition space for the mounting portion 118 is secured downstream (apparatus front side) of the maintenance mechanism 130 in the depth direction Y, below the carriage 30. In the apparatus depth direction Y, the downstream end of the waste liquid container 150 is positioned downstream of the downstream end of the carriage 30. A handle portion 151*a* (see also FIG. 10) protruding horizontally at the downstream end of the waste liquid container 150 overlaps the panel unit 23 in the vertical direction.

Position Relationship Between Components in Liquid Container and Pouring Position As illustrated in FIGS. 5 and 7, the user pours ink reduced by performing recording or the like into the liquid container 34 mounted to the carriage 30. The liquid ejection apparatus 11 is configured to be able to pour the ink into the liquid container 34 in a state where the scanner unit 14 is open.

As illustrated in FIG. 7, a plurality of liquid containers 34 corresponding to a plurality of colors are loaded on the carriage 30. A lid member 36 capable of opening and closing an inlet 35 (see FIG. 3) for pouring liquid into a containing chamber 37 is provided at an upper part of each liquid container 34. The lid member 36 opens and closes the inlet 35 by rotating substantially the rear side as an axis. The inlet 35 is positioned on downstream in the transport direction in the casing 12 of the liquid ejection apparatus 11.

As illustrated in FIG. 5, the containing chamber 37 for storing liquid to be supplied to the liquid ejection head 20 includes, at least in part, a remaining amount checking section 37*a* formed of a material having transparency so that the remaining amount of liquid inside thereof can be visually recognized. The entire containing chamber 37 including the remaining amount checking section 37*a* positioned on the front side is formed of a transparent or semi-transparent resin material (plastics including polyethylene, polystyrene, and the like).

As illustrated in FIG. 5, a visual recognition section 30*a* through which the remaining amount checking section 37*a* of the containing chamber 37 can be visually recognized is provided in the carriage 30 on which the liquid container 34 including the containing chamber 37 is loaded. Specifically, as illustrated in FIG. 7, the carriage 30 has a box shape having an open upper part, and the liquid container 34 is loaded in a form in which the containing chamber 37 is accommodated in the box-shaped carriage 30. The visual recognition section 30*a* is formed by partially cutting out a side surface on the apparatus front side of the carriage 30.

As illustrated in FIG. 7, a notch 25 is provided on the front surface 12*a* of the casing 12. In the ink pouring mode, the carriage 30 moves to a position that overlaps the notch 25 in the scanning direction.

As illustrated in FIG. 3, since the carriage 30 scans in the apparatus width direction, when the liquid ejection apparatus 11 is viewed from the width direction, even if the carriage 30 moves, the carriage 30 and the inlet 35 are always at the same position. In FIG. 3, the carriage 30 and the mounting portion 118 overlap in the vertical direction, the inlet 35 and the mounting portion 118 overlap in the vertical direction, and the carriage 30 and the substrate coupling portion 143 overlap in the vertical direction.

As illustrated in FIGS. 4 and 5, whether or not the carriage 30 and the inlet 35 are disposed so as to overlap the mounting portion 118 and the substrate coupling portion 143 in the vertical direction is determined by the position of the carriage 30. In the figured (FIGS. 4 and 5) of the liquid ejection apparatus 11 when viewed from the front of the apparatus, when the carriage 30 and the inlet 35 overlap the mounting portion 118 and the substrate coupling portion 143 (see FIG. 9) in the vertical direction, the carriage 30 and the inlet 35 are disposed so as to overlap in the vertical direction.

As illustrated in FIG. 5, in the ink pouring mode, when liquid is poured from the inlet 35 (see FIG. 3), the carriage 30 moves to a pouring position RP where the inlet 35 and the mounting portion 118 do not overlap in the vertical direction. In FIG. 5, positions of the five inlets 35 in the scanning direction are illustrated as inlet positions 35*a*, 35*b*, 35*c*, 35*d*, and 35*e* from the home position HP side. In this embodiment, the carriage 30 moves to the pouring position RP where the inlet positions 35*a*, 35*b*, 35*c*, 35*d*, and 35*e* do not overlap the mounting portion 118 in the vertical direction. That is, the carriage 30 moves to the pouring position RP where all the inlets 35 do not overlap the mounting portion 118 in the vertical direction.

As illustrated in FIG. 5, when a plurality of liquid containers 34 are loaded on the carriage 30 and liquid is poured from one inlet 35, the carriage 30 may move to the pouring position RP where the one inlet 35 and the mounting portion 118 do not overlap in the vertical direction.

As illustrated in FIG. 5, in the ink pouring mode, when liquid is poured from the inlet 35 (see FIG. 3), the carriage 30 is at a position that does not overlap the mounting portion 118 in the vertical direction. When the liquid is poured from the inlet 35, the carriage 30 is at a position that does not overlap the substrate coupling portion 143 (see FIG. 3) in the vertical direction. In this embodiment, when the carriage 30 is at the pouring position RP illustrated in FIG. 5 where the user pours the liquid from the inlet 35 (see FIG. 3), the carriage 30 is at a position that does not overlap the mounting portion 118 in the vertical direction. When the carriage 30 is at the pouring position RP illustrated in FIG. 5, the carriage 30 is at a position that does not overlap the substrate coupling portion 143 (see FIG. 3) in the vertical direction.

Position Relation Between Components at Home Position

As illustrated in FIG. 4, when the liquid ejection head 20 moves to the home position HP, the liquid ejection head 20 is located on the right (−X-direction side of the right end RE of the transport path 40) outside of the transport path 40 in the scanning direction, and the carriage 30 is disposed at a position that overlaps the mounting portion 118 in the vertical direction.

As illustrated in FIG. 4, in this embodiment, since the length of the carriage 30 in the X-direction is longer than that of the mounting portion 118, the mounting portion 118 entirely overlaps the carriage 30 in the vertical direction, and the carriage 30 is disposed at a position where the carriage 30 partially overlaps the mounting portion 118 in the vertical direction.

As illustrated in FIG. 3, the inlet 35 is provided on a downstream region in the transport direction in the casing 12. As illustrated in FIG. 4, when the liquid ejection head 20 is outside the transport path 40 in the scanning direction, the inlet 35 is disposed at a position that overlaps the mounting portion 118 in the vertical direction. In this embodiment, as illustrated in FIG. 4, the first to third inlets from the home position HP side (the right end side in FIG. 4) are disposed at positions that overlap the mounting portion 118 in the vertical direction.

As illustrated in FIG. 4, when the inlet 35 overlaps the mounting portion 118 in the vertical direction, an opening/closing inhibiting portion 24 inhibits opening and closing of the lid member 36. In this embodiment, when the inlet positions 35*a*, 35*b*, and 35*c* overlap the mounting portion 118 in the vertical direction, the opening/closing inhibiting portion 24 inhibits opening and closing of all the lid members 36. That is, when the first to third inlets 35 from the home position HP side (the right end side in FIG. 4) overlap the mounting portion 118 in the vertical direction, the opening/closing inhibiting portion 24 inhibits opening and closing of all the lid members 36.

In this embodiment, when the carriage 30 stops at the home position HP, the opening/closing inhibiting portion 24 inhibits opening and closing of all the lid members 36. At this time, at least one of the plurality of inlets 35 overlaps the mounting portion 118 in the vertical direction. In this way, a configuration in which, at the stop position of the carriage 30 where at least one inlet 35 overlaps the mounting portion 118 in the vertical direction, the opening/closing inhibiting portion 24 inhibits the user from pouring the ink into the liquid container 34 by inhibiting opening and closing of the lid member 36, is adopted.

About Mounting of Waste Liquid Container

Figure 8:
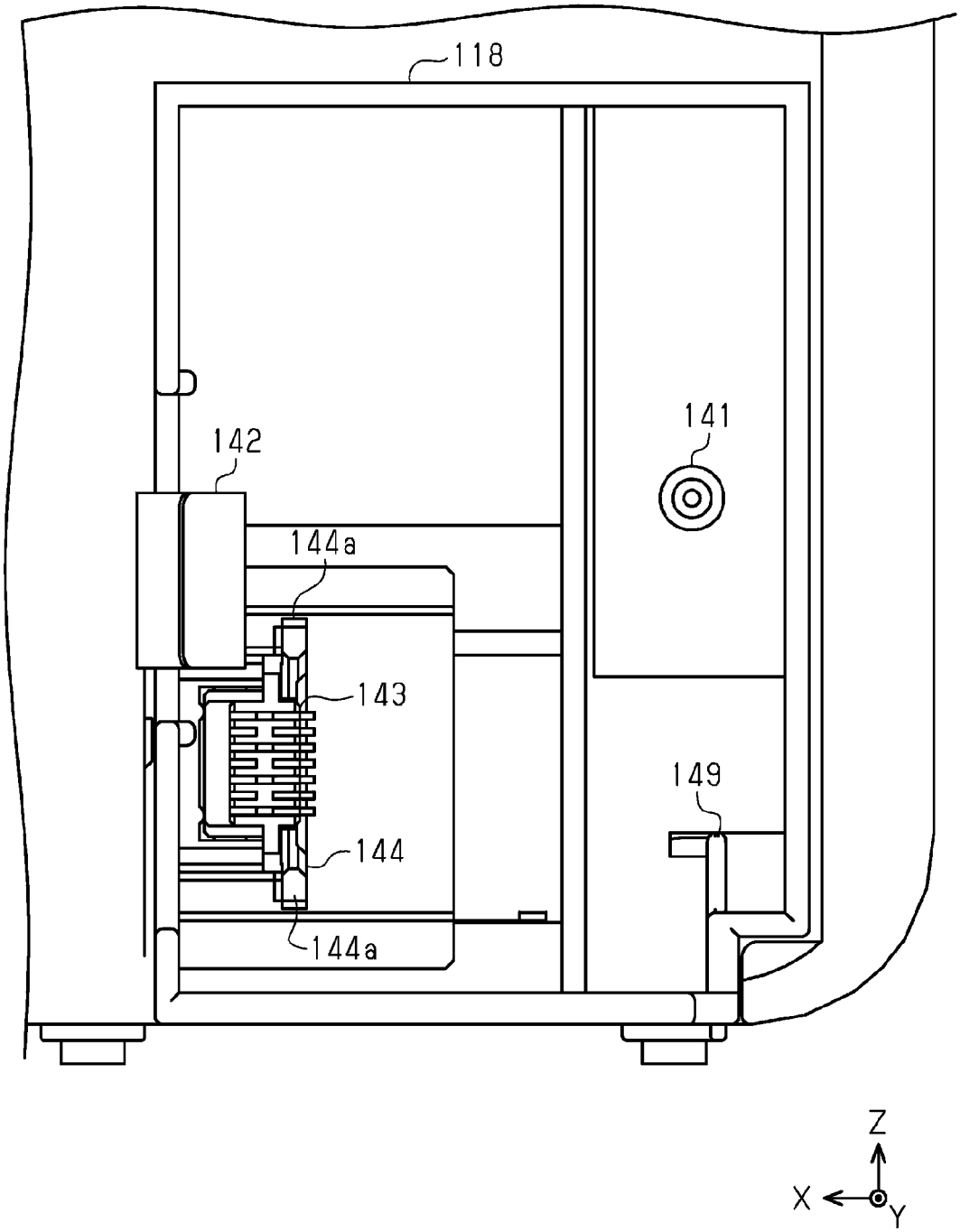
FIG. 8 is a front view illustrating a mounting portion of the liquid ejection apparatus.

As illustrated in FIG. 8, the mounting portion 118 includes a discharge portion 141 that communicates with the discharge tube 135 (see FIG. 3) to discharge waste liquid, a locking portion 142, and a protruding portion 144 to which the substrate coupling portion 143 is attached.

Figure 9:
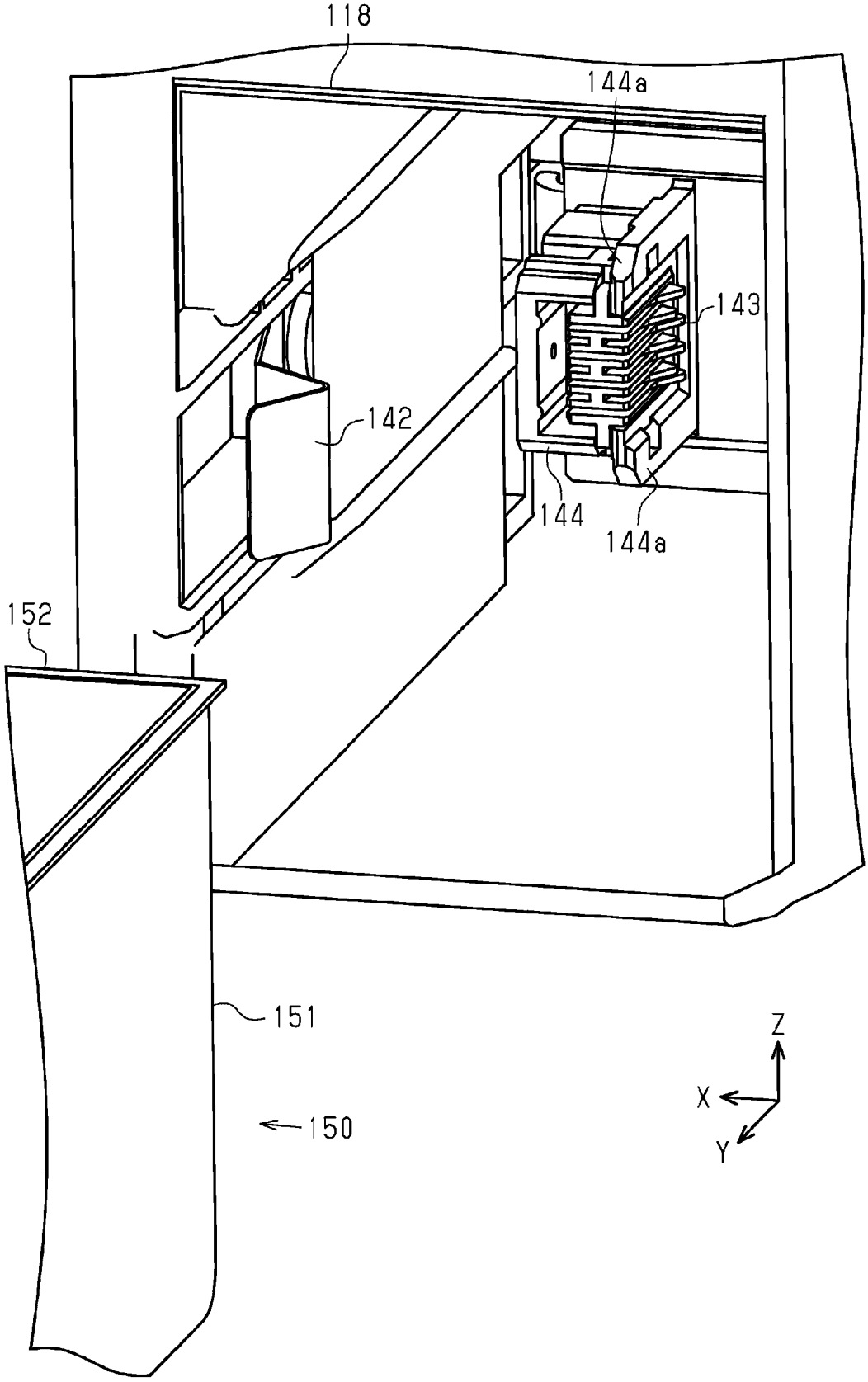
FIG. 9 is a perspective view illustrating the mounting portion of the liquid ejection apparatus.

As illustrated in FIG. 9, the locking portion 142 locks the waste liquid container 150 inserted into the mounting portion 118. For example, the locking portion 142 is made of a leaf spring. The substrate coupling portion 143 is electrically coupled to the control section 200 (see FIG. 3). The protruding portion 144 includes a pair of guide projections 144*a* that protrudes upward and downward.

As illustrated in FIG. 8, in the mounting portion 118, the discharge portion 141 is disposed above the substrate coupling portion 143. Below the discharge portion 141, a step portion 149 extending in the mounting direction from the vicinity of the opening of the mounting portion 118 toward the depth side is provided. When the direction along the scanning direction is set as the width direction, the discharge portion 141 and the step portion 149 are disposed on the right side (−X-direction side) of a predetermined position (for example, the center) in the width direction, and the locking portion 142 and the protruding portion 144 are disposed on the left side (+X-direction side) of the predetermined position described above in the width direction.

As illustrated in FIG. 9, the waste liquid container 150 includes a bottomed box-shaped containing case 151 whose upper side is open in a state of being mounted to the mounting portion 118, and a case lid 152 that covers the opening of the containing case 151.

Figure 10:
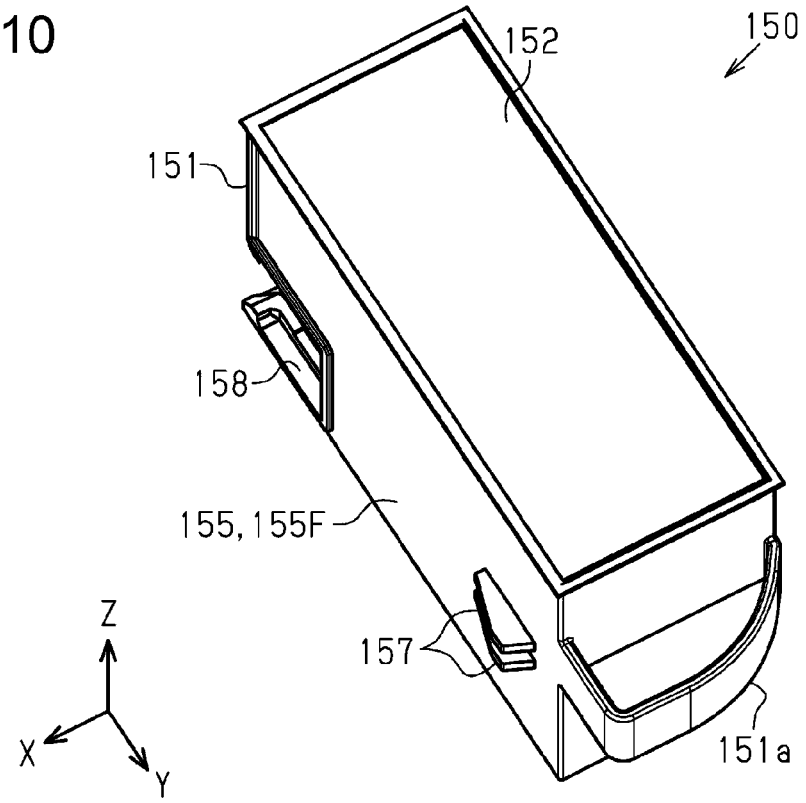
FIG. 10 is a perspective view illustrating a waste liquid container.

As illustrated in FIG. 10, the waste liquid container 150 has a substantially rectangular parallelepiped shape in which the mounting direction is a long side. The containing case 151 includes a handle portion 151*a* at an end portion on the front side in the mounting direction. When attaching and detaching the waste liquid container 150 to and from the mounting portion 118 (see FIG. 9), the user places his/her hand on the handle portion 151*a*, inserts the waste liquid container 150 into the mounting portion 118 (see FIG. 9), and takes out the waste liquid container 150 from the mounting portion 118.

Figure 11:
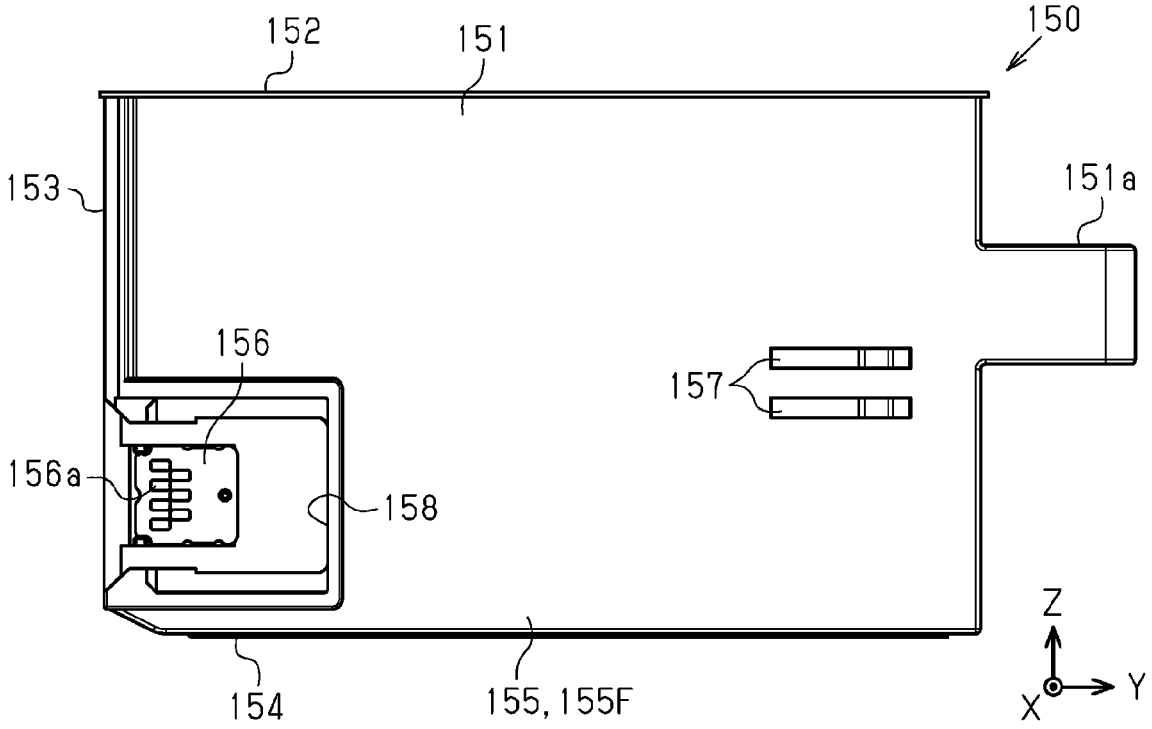
FIG. 11 is a side view illustrating one side surface of the waste liquid container.

As illustrated in FIG. 11, the containing case 151 includes a mounting surface 153 that is an outer surface on the depth side in the mounting direction, a bottom surface 154 that becomes a lower surface when mounted, and a pair of side surfaces 155 which are outer surfaces extending in a direction intersecting the width direction when the scanning direction is set as the width direction. The pair of side surfaces 155 are a first side surface 155F and a second side surface 155S.

As illustrated in FIG. 11, the waste liquid container 150 includes a circuit substrate 156 including a coupling terminal 156*a* that is electrically coupled to the substrate coupling portion 143 (see FIG. 9) at the time of mounting to the mounting portion 118 (see FIG. 9). In the circuit substrate 156, information such as a containing amount of the waste liquid container 150 is stored. On the first side surface 155F of the containing case 151, an engagement projection 157 that engages with the locking portion 142 (see FIG. 9) when inserted into the mounting portion 118 (see FIG. 9) is projected.

Figure 12:
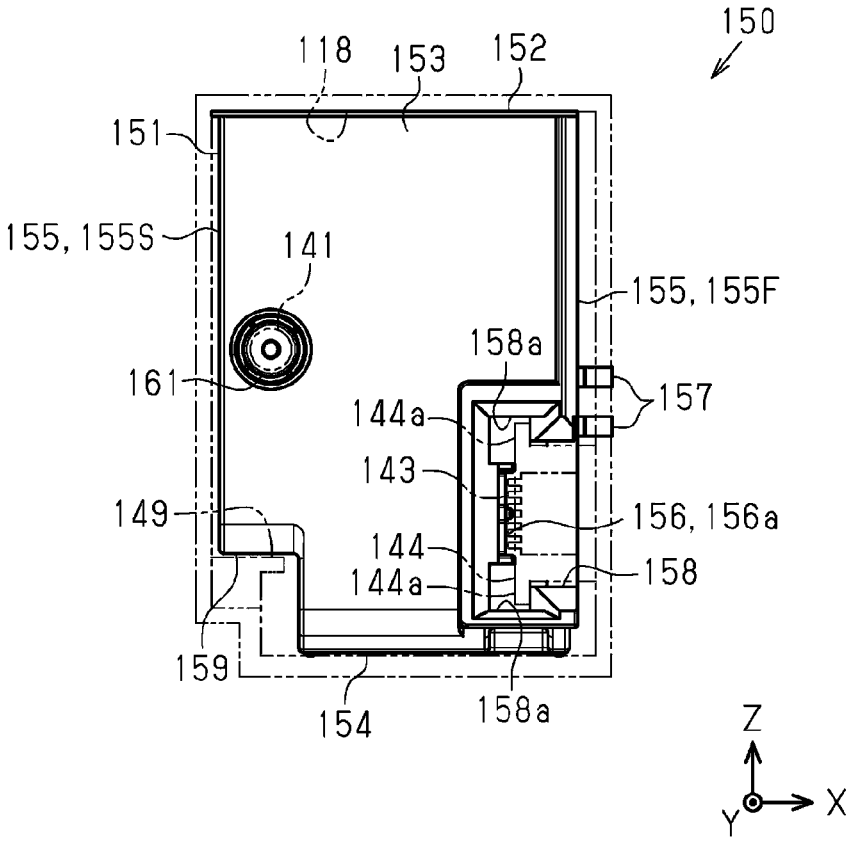
FIG. 12 is a rear view illustrating the waste liquid container.

As illustrated in FIG. 12, the waste liquid container 150 includes a waste liquid introduction portion 161 coupled to the discharge portion 141 at the time of mounting to the mounting portion 118. The containing case 151 includes a recess 158 that opens to the mounting surface 153 and the first side surface 155F and allows the protruding portion 144 to be inserted at the time of mounting to the mounting portion 118, and a notch 159 that opens to at least the mounting surface 153 and the second side surface 155S vertically below the waste liquid introduction portion 161.

As illustrated in FIG. 12, in the containing case 151, the notch 159 may be provided directly below the waste liquid introduction portion 161. The recess 158 may be provided between a predetermined position (for example, the center) in the width direction and the first side surface 155F, and the waste liquid introduction portion 161 and the notch 159 are preferably provided between a reference position and the second side surface 155S in the width direction. The reference position is made to correspond to a reference position when the discharge portion 141 and the protruding portion 144 are disposed in the mounting portion 118.

As illustrated in FIG. 12, the circuit substrate 156 is disposed in the recess 158 including the coupling terminal 156*a*. In the recess 158, guide grooves 158*a* engageable with the guide projection 144*a* of the protruding portion 144 are recessed above and below the circuit substrate 156. The circuit substrate 156 is attached to the containing case 151 so that the coupling terminals 156*a* face the outside along the width direction in the recess 158. The notch 159 is formed so as to extend from the mounting surface 153 in the taking-out direction.

Next, the operation of the liquid ejection apparatus 11 will be described.

When the liquid ejection apparatus 11 is not performing a printing operation, the carriage 30 is positioned at the home position HP, and the liquid ejection head 20 is in a state of being capped by the cap 131. When receiving print data, the control section 200 starts the printing operation of the liquid ejection apparatus 11. By rotation of the feed roller 26, the uppermost one of the media P on the medium tray 21 is sent out. The sent out medium P is transported toward the recording section 18 via the outer periphery of the intermediate roller 27. When the medium P passes through the recording position of the recording section 18, the medium P is transported along the transport path 40 on the medium support member 33. An image or a character based on print data is printed on the medium P by alternately and repeatedly performing a recording operation of performing recording for one scan on the medium P by ejecting liquid from the liquid ejection head 20 while the carriage 30 moves in the scanning direction and a transport operation of transporting the medium P to the next recording position. By performing the printing, liquid in the liquid container 34 is consumed.

When the cleaning time comes, the control section 200 performs cleaning in a state where the carriage 30 is positioned at the home position HP. When the carriage 30 is at the home position HP, the liquid ejection head 20 is positioned outside the transport path 40 in the scanning direction. The control section 200 moves the cap 131 from a retracted position to a capping position to form a closed space between the cap 131 and the liquid ejection head 20 where the nozzle communicates. The control section 200 forcibly sucks and discharges the liquid from the nozzles by driving the suction pump 134 to introduce negative pressure into the cap 131. The liquid discharged from the liquid ejection head 20 by this cleaning is collected in the waste liquid container 150 through the cap 131 and the discharge tube 135 as waste liquid. The control section 200 performs idle ejection (flushing) in which the carriage 30 is periodically moved to the home position HP during printing to eject liquid from the liquid ejection head 20 to the cap 131. The waste liquid remaining in the cap 131 due to multiple idle ejections is collected in the waste liquid container 150 through the discharge tube 135 by idle suction performed by driving the suction pump 134. The liquid in the liquid container 34 is also consumed by maintenance including this cleaning.

As illustrated in FIG. 4, by disposing the maintenance mechanism 130 and the mounting portion 118 at positions where the maintenance mechanism 130 and the mounting portion 118 overlap in the vertical direction, the length in the width direction required outside the transport path 40 in the scanning direction on the side where the mounting portion 118 is mounted is reduced compared to the case where the maintenance mechanism 130 and the mounting portion 118 are disposed at positions where the maintenance mechanism 130 and the mounting portion 118 do not overlap. That is, the length in the width direction of the liquid ejection apparatus 11 can be reduced.

As illustrated in FIG. 4, when performing the cleaning operation of the liquid ejection head 20 or performing the capping operation to prevent the nozzle 120 of the liquid ejection head 20 from drying, the carriage 30 is positioned at the home position HP where the liquid ejection head 20 is outside the transport path 40 in the scanning direction.

A plurality of liquid containers 34 corresponding to a plurality of colors are loaded on the carriage 30 side by side in the scanning direction, and when the carriage 30 moves to a position where all the ejection positions of the liquid ejection heads 20 are positioned outside the transport path 40 in the scanning direction, at least half of the length of the carriage 30 in the scanning direction is positioned outside the transport path 40 in the scanning direction. For that reason, when the liquid ejection head 20 is positioned outside the transport path 40 in the scanning direction, the carriage 30 is disposed at a position that overlaps the mounting portion 118 in the vertical direction, so that the space outside the transport path 40 in the scanning direction is smaller than when the carriage 30 is disposed at a position that does not overlap the mounting portion 118. Therefore, the length dimension in the width direction of the portion of the liquid ejection apparatus 11 outside the transport path 40 in the scanning direction is short.

As illustrated in FIG. 2, the length of the liquid ejection apparatus 11 in the depth direction requires a length for placing the medium P on the medium tray 21, and there is room for space. As illustrated in FIG. 3, in order to load the waste liquid container 150 which is detachably mounted to the liquid ejection apparatus 11, the liquid ejection head 20 is disposed on the apparatus rear side of the carriage 30. Then, while maintaining the condition that the cap 131 is positioned directly below the liquid ejection head 20, the mounting portion 118 is disposed in an accommodation space secured in front of the apparatus by retracting the maintenance mechanism 130 to the apparatus rear side. Therefore, the depth dimension of the waste liquid container 150 mounted to the mounting portion 118 can be secured long, and thus the width dimension required for the waste liquid container 150 is relatively short. Then, in this embodiment, when the carriage 30 is at the home position HP, the outer end surface of the mounting portion 118 is positioned inside the outer end surface of the carriage 30 in the scanning direction. Also from this point, the liquid ejection apparatus 11 does not increase in size in the width direction X.

As illustrated in FIG. 2, in order to allow the user to pull out the medium tray 21 when replenishing the medium P to the medium tray 21, a work space is secured in front of the apparatus, which is downstream in the transport direction in the casing 12. Since the medium P after recording is stacked on the discharge tray 22, the work space is secured in front of the apparatus, which is downstream in the transport direction outside the casing 12. In this embodiment, the waste liquid container 150 can be attached to and detached from the mounting portion 118 from downstream (front surface 12*a* side) in the transport direction of the casing 12. For that reason, a work space required when removing the waste liquid container 150 is not required outside in the scanning direction (width direction) of the liquid ejection apparatus 11 and upstream in the transport direction outside the casing 12. That is, the waste liquid container 150 can be attached and detached at the time of replacement or the like by using the medium tray 21 and the work space secured in front of the apparatus for attaching and detaching the medium tray 21.

When the printing operation is repeated, ink is consumed by printing. When the remaining amount of the ink falls below a threshold value, notification is given on the operation surface 16*a* that the remaining amount of the ink is low. When the user issues an instruction to pour ink through the operation surface 16*a*, the liquid ejection apparatus 11 enters the ink pouring mode, and the carriage 30 moves from the home position HP to the pouring position RP (see FIG. 7) and stops.

As illustrated in FIG. 7, when the user opens the scanner unit 14, the user checks that the carriage 30 has stopped at the pouring position RP (see FIG. 7). In a state where the scanner unit 14 is opened, the panel unit 23 is held at an angle at which the user can easily view the operation surface 16*a* of the operation section 16. The user can satisfactorily read a message displayed on the operation surface 16*a* when pouring the ink into the liquid container 34.

As illustrated in FIG. 7, the notch 25 is provided on the front surface 12*a* of the casing 12. The pouring position RP is a position where the carriage 30 overlaps the notch 25 in the scanning direction. By providing the visual recognition section 30*a* on the carriage 30, the user views the remaining amount checking section 37*a* (see FIG. 5) in a state where the containing chamber 37 is loaded on the carriage 30. Since none of the lid members 36 are covered by the opening/closing inhibiting portion 24, the user can open any of the lid members 36. The user opens the lid member 36 for which notification that the remaining amount is small is given and pours ink in the liquid container 34 from the liquid replenishing container into the containing chamber 37 while checking an amount of the ink.

Since the inlet 35 is provided on a downstream region in the transport direction in the casing 12 of the liquid ejection apparatus 11, when the user pours the liquid in the liquid replenishing container into the containing chamber 37, there is little possibility that the liquid replenishing container hits the scanner unit 14 or the panel unit 23. Even if the liquid replenishing container hits the scanner unit 14 or the panel unit 23, the user can pour the liquid in the liquid replenishing container into the containing chamber 37 simply by slightly tilting the liquid replenishing container from an overturned posture. Since the inlet 35 is provided on a downstream region in the transport direction in the casing 12 of the liquid ejection apparatus 11, the user can pour ink while checking the amount of ink in the liquid container 34. The user can perform the ink pouring work at the wide opening near the front of an upper surface opening of the casing 12, so that the ink pouring work is easy.

As illustrated in FIG. 5, a plurality of liquid containers 34 loaded on the liquid ejection apparatus 11. When the carriage 30 is at the pouring position RP, all the inlet positions 35*a*, 35*b*, 35*c*, 35*d*, and 35*e* and the mounting portion 118 are disposed at positions where the inlet positions 35*a*, 35*b*, 35*c*, 35*d*, and 35*e* and the mounting portion 118 do not overlap in the vertical direction, ink dripping from the inlet (see FIG. 3) does not adhere to the mounting portion 118. Since the carriage 30 and the mounting portion 118 are disposed at positions where the carriage 30 and the mounting portion 118 do not overlap in the vertical direction, ink dripping from the carriage 30 does not adhere to the mounting portion 118. Since the carriage 30 and the substrate coupling portion 143 are disposed at positions where the carriage 30 and the substrate coupling portion 143 do not overlap in the vertical direction, ink dripping from the carriage 30 does not adhere to the substrate coupling portion 143.

The liquid container 34 may include a remaining amount detection section capable of detecting that the amount of liquid contained in the containing chamber 37 has fallen below a first threshold. The liquid container 34 may include a full detection section capable of detecting that the liquid is further poured into the containing chamber 37 and the amount of the liquid in the containing chamber 37 has reached a second threshold larger than the first threshold.

As illustrated in FIG. 7, since the visual recognition section 30*a* is provided on the side surface on the front side of the carriage 30, the user can easily see the remaining amount checking section 37*a* (see FIG. 5). Since the containing chamber 37 is provided at a position above the liquid ejection head 20, the remaining amount checking section 37*a* (see FIG. 5) and the visual recognition section 30*a* are necessarily positioned above the liquid ejection head 20, so that the user's line of sight when viewing the remaining amount of liquid is also increased, and visibility is further improved.

When the pouring of ink is completed, the user closes the lid member 36, closes the scanner unit 14, and operates the operation section 16 to end the ink pouring mode. When the ink pouring mode is ended, the carriage 30 returns to the home position HP. There is a sensor (not illustrated) that detects that the scanner unit 14 is closed, and when the sensor detects the closed state of the scanner unit 14, the control section 200 drives a carriage motor 170 (see FIG. 3), and the carriage 30 moves to the home position HP.

When the lid member 36 is not closed, the carriage 30 may not be able to move to the home position HP. For example, if the lid member 36 comes into contact with the opening/closing inhibiting portion 24 when the lid member 36 is not closed, the control section 200 (see FIG. 3) detects driving load of the carriage motor 170 (see FIG. 3) and stops the carriage motor 170. That is, the carriage 30 may be stopped at a position where the lid member 36 contacts the opening/closing inhibiting portion 24. At this time, the liquid ejection apparatus 11 may notify the operation surface 16*a* of information indicating that the lid member 36 is not closed and information that prompts the user to close the lid member 36.

As illustrated in FIG. 6, the scanner unit 14 is opened when a jammed medium P is removed from the transport path 40 when a jam occurs during printing, for example. As described above, the scanner unit 14 can be opened during a non-printing operation in which a printing operation is not performed, including during an emergency stop. For example, the user may open the scanner unit 14 when the liquid ejection apparatus 11 is not printing. In this case, the carriage 30 normally stops at the home position HP (see FIG. 6).

As illustrated in FIGS. 4 and 6, when the carriage 30 is positioned at the home position HP, the user cannot open the lid member 36 because all the lid members 36 are covered by the opening/closing inhibiting portion 24. That is, at the position of the carriage 30 when the inlet positions 35*a*, 35*b*, and 35*c* overlap the mounting portion 118 in the vertical direction, the opening/closing inhibiting portion 24 inhibits opening and closing of the lid member 36. Therefore, in a state where the carriage 30 is positioned at the home position HP and the inlet positions 35*a*, 35*b*, and 35*c* overlap the mounting portion 118 in the vertical direction, the user cannot open the lid member 36 by the opening/closing inhibiting portion 24. That is, when the carriage 30 is at the home position HP, the user cannot pour ink into the liquid container 34. As a result, it is possible to avoid liquid dripping onto the mounting portion 118 and the waste liquid container 150, which is caused by an action of the user pouring the ink into the liquid container 34 when the carriage 30 is at the home position HP.

As illustrated in FIG. 3, when the liquid ejection apparatus 11 executes a maintenance operation such as cleaning, waste liquid discharged from the liquid ejection head 20 is introduced into the waste liquid container 150 through the discharge portion 141 (see FIG. 8) and the waste liquid introduction portion 161 (see FIG. 12). The control section 200 subtracts the stored containing amount of the waste liquid container 150 by an amount of the discharged waste liquid, and stores a value indicating the subtracted containing amount in the circuit substrate 156 (see FIG. 12). When there is space available for the containing amount of waste liquid in the waste liquid container 150, the control section 200 allows introduction of the waste liquid into the waste liquid container 150. When the containing amount of the waste liquid container 150 is almost full, the control section 200 issues a notification to the effect that the waste liquid container 150 is to be replaced through the operation surface 16*a* (see FIG. 1).

As illustrated in FIG. 3, when the lower cover 17 is disposed at the open position, the containing body cover 117 detachably mounted to the casing 12 is exposed. The user removes the containing body cover 117, puts his hand on the handle portion 151*a* of the waste liquid container 150, pulls the waste liquid container 150 being full forward from the mounting portion 118, and removes the waste liquid container 150 from the liquid ejection apparatus 11. Since no ink has adhered to the mounting portion 118 and the substrate coupling portion 143, no ink has also adhered to the waste liquid container 150, which is mounted in a state of being inserted into the box-shaped mounting portion 118 having an open front surface, as well. Therefore, the user does not need to stain his hands with ink.

As illustrated in FIG. 9, the mounting portion 118 is at a position where the waste liquid container 150 can be mounted detachably from the apparatus front side. The direction in which the user removes the waste liquid container 150 from the mounting portion 118 is the same as the direction in which the user pulls out the discharge tray 22

(see FIG. 2), and the direction is the same as the direction in which the user pulls out the medium tray 21 when the user replenishes the medium tray 21 with the medium P. In addition to the operation of the medium tray 21 and the discharge tray 22, both the inlet 35 and the mounting portion 118 are at positions where the user in front of the liquid ejection apparatus 11 can operate.

As illustrated in FIG. 9, the user replaces the waste liquid container 150 being full with an unused waste liquid container 150. When the user moves the unused waste liquid container 150 in the mounting direction with respect to the mounting portion 118, the locking portion 142 is engaged with the engagement projection 157, and the movement of the waste liquid container 150 in the taking-out direction is regulated.

By moving the waste liquid container 150 in the mounting direction, the discharge portion 141 (see FIG. 8) is coupled to the waste liquid introduction portion 161 of the waste liquid container 150, the coupling terminal 156*a* of the circuit substrate 156 comes into contact with the substrate coupling portion 143, and the circuit substrate 156 and the control section 200 (see FIG. 3) are electrically coupled. At this time, the guide projection 144*a* of the protruding portion 144 is engaged with the guide groove 158*a* of the waste liquid container 150, so that the coupling terminal 156*a* of the circuit substrate 156 is accurately positioned with respect to the substrate coupling portion 143. The control section 200 (see FIG. 3) detects that the waste liquid container 150 is mounted by being electrically coupled to the circuit substrate 156. When the mounting of the waste liquid container 150 is not detected even after the lapse of a predetermined time from the removal of the waste liquid container 150, the control section 200 notifies the user of the fact by displaying information indicating that the mounting is not detected and information such as a message urging the user to mount the waste liquid container 150 on the operation surface 16*a*.

According to the embodiment described above, the following effects can be obtained.

(1) The mounting portion 118 is outside the transport path 40 in the scanning direction and downstream in the transport direction in the casing 12, and when the liquid ejection head 20 is outside the transport path 40 in the scanning direction, the carriage 30 is disposed at a position that overlap the mounting portion 118 in the vertical direction. Since the length in the width direction outside the transport path 40 in the scanning direction does not increase, the overall length of the liquid ejection apparatus 11 in the width direction does not become larger than that of the liquid ejection apparatus having a configuration in which the carriage does not overlap the mounting portion in the vertical direction when the liquid ejection head 20 is outside the transport path 40 in the scanning direction. That is, even if the mounting portion 118 and the waste liquid container 150 are disposed, the mounting area of the liquid ejection apparatus 11 when placed on a desk or floor does not need to be large. The mounting portion 118 is provided outside the transport path 40 in the scanning direction and downstream in the transport direction in the casing 12, and thus has good operability when attaching and detaching the waste liquid container 150.

(2) The mounting portion 118 is configured to attach and detach the waste liquid container 150 to and from downstream in the transport direction of the casing 12. The user can remove the waste liquid container 150 from the front of the apparatus, which is downstream in the transport direction of the casing 12. The direction in which the user removes the waste liquid container 150 is the same as the direction in which the discharge tray 22 extends from the casing 12, the direction is the same as the direction in which the user pulls out the discharge tray 22, and the direction is the same as the direction in which the user pulls out the medium tray 21 when the user replenishes the medium tray 21 with the medium P. The user also operates the operation surface 16*a* from the front of the apparatus. A space is already secured at the front of the apparatus which is downstream in the transport direction of the casing 12, and a new work space is not required. Therefore, the mounting area of the liquid ejection apparatus 11 does not need to be large, and an occupied space including the working space does not need to be large.

(3) Both the inlet 35 and the mounting portion 118 are at positions that can be operated by the user. When the user pours the liquid from the inlet 35, the pouring operation can be performed from the front of the apparatus, which is downstream in the transport direction of the casing 12. When the user mounts the waste liquid container 150 to the mounting portion 118, the mounting operation can be performed from the front of the apparatus, which is downstream in the transport direction of the casing 12. When the user takes out the waste liquid container 150 from the mounting portion 118, the taking-out operation can be performed from the front of the apparatus, which is downstream in the transport direction of the casing 12. In addition to the operation of the medium tray 21 and the discharge tray 22, the user can perform both the operation of pouring the liquid from the inlet 35 and the operation of attaching and detaching the waste liquid container 150 to and from the mounting portion 118 from the front of the apparatus, which is downstream in the transport direction of the casing 12, and workability of the user is improved. Since all operations can be performed from the front of the apparatus, the degree of freedom of the installation place is increased.

(4) When the user pours liquid from the inlet 35, the liquid may be spilled from the inlet 35. When the liquid moves in the vertical direction along the surface of the carriage 30 due to gravity by using a portion extending from the one inlet 35 to the carriage 30 as a path, the liquid does not reach the mounting portion 118. The mounting portion 118 is connected to the waste liquid container 150. That is, it is possible to suppress that the liquid adheres to the waste liquid container 150 handled by the user.

(5) In a case where a plurality of liquid containers 34 are loaded on the liquid ejection apparatus 11, when the user pours liquid from one inlet 35, the liquid may be spilled from the one inlet 35. When the liquid moves in the vertical direction along the surface of the carriage 30 due to gravity by using a portion extending from the inlet 35 to the carriage 30 as a path, the liquid does not reach the mounting portion 118. The waste liquid container 150 is mounted to the mounting portion 118. That is, it is possible to suppress that the liquid adheres to the waste liquid container 150 handled by the user.

(6) When the user pours liquid from the inlet 35, the liquid may be spilled from the inlet 35. When the liquid moves in the vertical direction along the surface of the carriage 30 due to gravity and in the horizontal direction (in the XY plane) along the surface of the carriage 30 due to wettability by using a portion extending from the inlet 35 to the carriage 30 as a path, the liquid does not reach the substrate coupling portion 143. The substrate coupling portion 143 is connected to the waste liquid container 150. That is, it is possible to suppress that the liquid adheres to the waste liquid container 150 handled by the user.

(7) When the user pours liquid from the inlet 35, the liquid may be spilled from the inlet 35. When the liquid moves in the vertical direction along the surface of the carriage 30 due to gravity and in the horizontal direction (in the XY plane) along the surface of the carriage 30 due to wettability by using a portion extending from the inlet 35 to the carriage 30 as a path, the liquid does not reach the mounting portion 118. The waste liquid container 150 is mounted to the mounting portion 118. That is, it is possible to suppress that the liquid adheres to the waste liquid container 150 handled by the user.

(8) At the position where the opening/closing inhibiting portion 24 inhibits opening and closing of the lid member 36, the user cannot open the lid member 36 whose opening and closing is inhibited. That is, the user is prevented from pouring the liquid at a position where the liquid dripped during the pouring may adhere to the waste liquid container 150.

Second Embodiment

Figure 13:
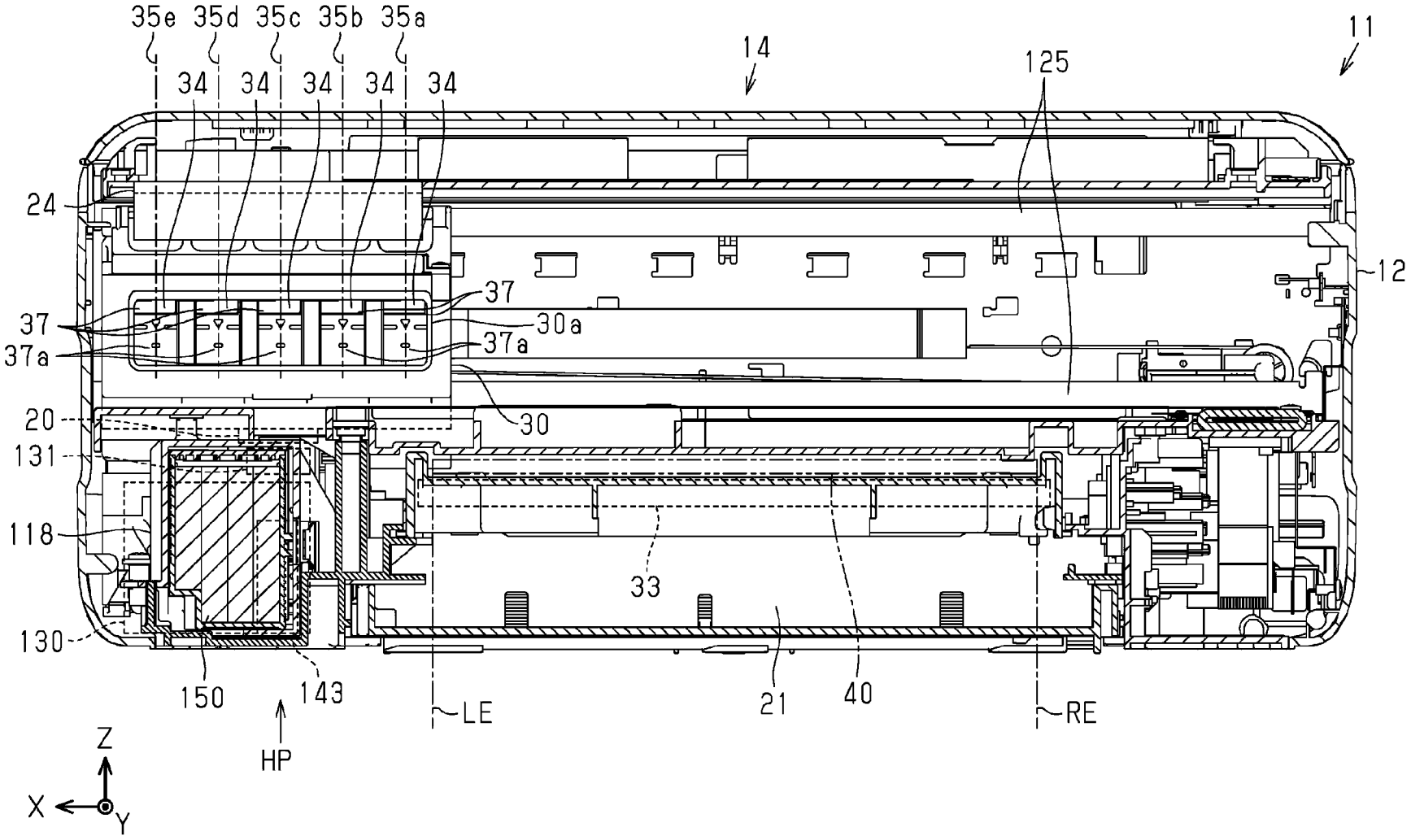
FIG. 13 is a front cross-sectional view illustrating a liquid ejection apparatus when a carriage is at a home position in a second embodiment.

Next, a second embodiment of the liquid ejection apparatus will be described with reference to FIGS. 13 and 14. As illustrated in FIG. 13, the second embodiment is different from the first embodiment in that the home position HP is at a position opposite to the home position HP (see FIG. 4) in the first embodiment in the width direction. The second embodiment is different from the first embodiment in that the mounting portion 118 is disposed on the left outside of the transport path 40 (+X side of the left end LE of the transport path 40) in the scanning direction. The other points are substantially the same as those of the first embodiment, and thus the same configurations are denoted by the same reference numerals, and the duplicate description will be omitted.

As illustrated in FIG. 13, when the liquid ejection head 20 moves to the home position HP, the liquid ejection head 20 is outside the home position HP side of the transport path 40 in the scanning direction, and the carriage 30 is disposed at a position overlaps the mounting portion 118 in the vertical direction.

As illustrated in FIG. 9, the waste liquid container 150 that contains liquid as waste liquid discharged from the liquid ejection head 20 is detachably mounted to the mounting portion 118 from the apparatus front side, which is downstream in the transport direction of the casing 12. However, the mounting portion 118 is on the right outside of the transport path 40 in the first embodiment (see FIG. 9), whereas the mounting portion 118 is on the left outside of the transport path 40 in the second embodiment, and thus the left and right of the mounting portion 118 in FIG. 9 are inverted in FIG. 13 of the second embodiment. Similarly, the left and right of the waste liquid container 150 of FIG. 10 are inverted in FIG. 13 of the second embodiment.

As illustrated in FIG. 3, the inlet 35 is provided downstream in the transport direction in the casing 12. As illustrated in FIG. 13, when the liquid ejection head 20 is outside the transport path 40 in the scanning direction, the inlet 35 is disposed at a position that overlaps the mounting portion 118 in the vertical direction.

Figure 14:
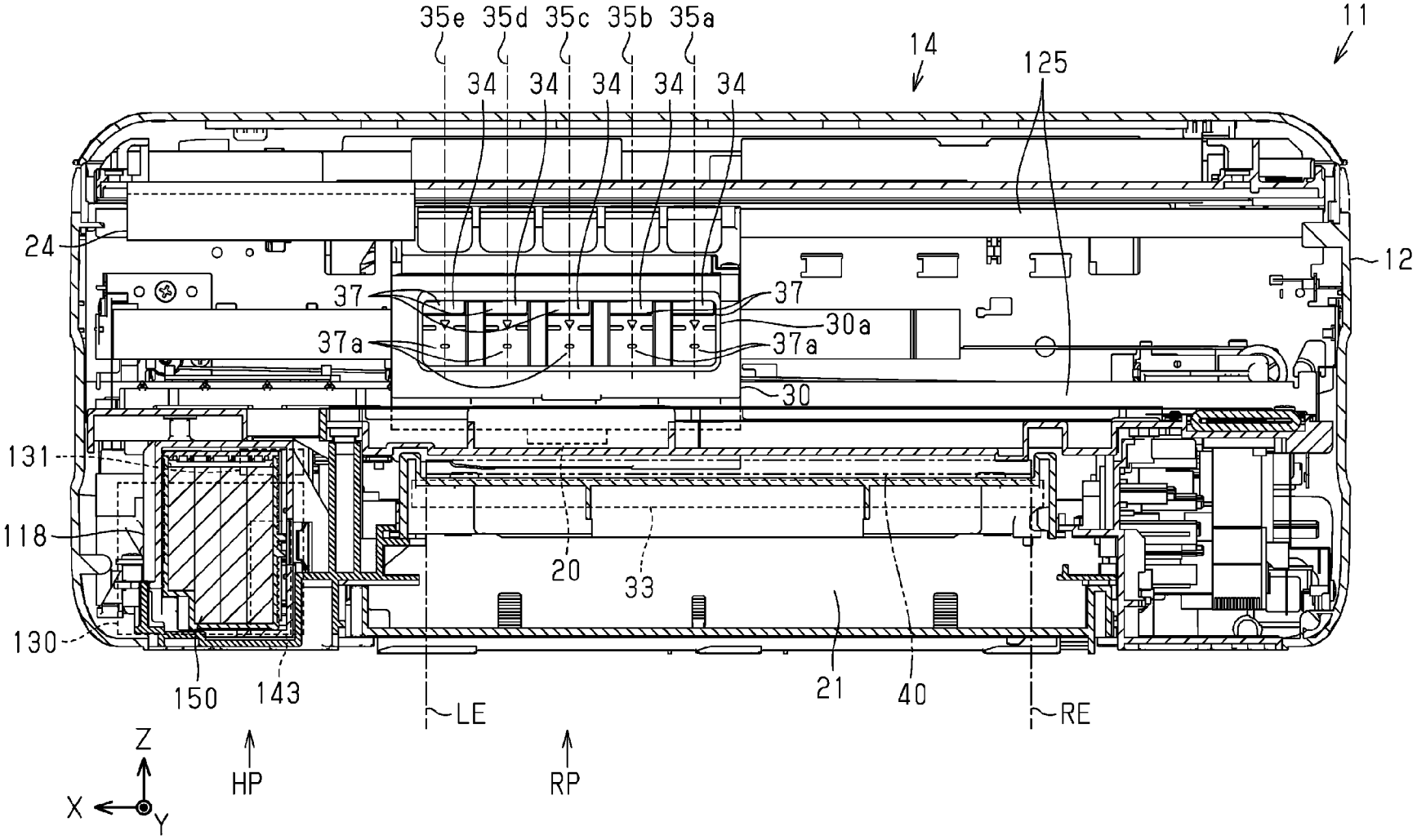
FIG. 14 is a front cross-sectional view illustrating the liquid ejection apparatus when the carriage is at an ink pouring position.

As illustrated in FIG. 14, when pouring liquid from the inlet 35 (not illustrated), the carriage 30 moves to the pouring position RP where the one inlet 35 and the mounting portion 118 do not overlap in the vertical direction. In FIG. 14, the positions on the X-axis of the five inlets 35 are illustrated as the inlet positions 35*a*, 35*b*, 35*c*, 35*d*, and 35*e* from the opposite home position side. In this embodiment, the carriage 30 moves to the pouring position RP where the inlet positions 35*a*, 35*b*, 35*c*, 35*d*, and 35*e* do not overlap the mounting portion 118 in the vertical direction. That is, the carriage 30 moves to the pouring position RP where all the inlets 35 do not overlap the mounting portion 118 in the vertical direction.

As illustrated in FIG. 14, a plurality of liquid containers 34 are loaded on the carriage 30, and when pouring liquid from one inlet 35, the carriage 30 may move to the pouring position RP where the one inlet 35 and the mounting portion 118 do not overlap in the vertical direction.

As illustrated in FIGS. 9 and 10, the mounting portion 118 (see FIG. 9) includes the substrate coupling portion 143 (see FIG. 9) that is electrically coupled to the circuit substrate 156 (see FIG. 11) provided in the waste liquid container 150 (see FIG. 10). However, the mounting portion 118 is on the right outside of the transport path 40 in the first embodiment (see FIG. 9), whereas the mounting portion 118 is on the left outside of the transport path 40 in the second embodiment, and thus the left and right of the mounting portion 118 in FIG. 9 are inverted in FIG. 14 of the second embodiment. Similarly, the left and right of the waste liquid container 150 of FIG. 10 are inverted in FIG. 14 of the second embodiment.

As illustrated in FIG. 14, the pouring position RP is a position where the carriage 30 does not overlap the substrate coupling portion 143 in the vertical direction (see FIG. 9). The pouring position RP is a position where the carriage 30 does not overlap the mounting portion 118 in the vertical direction.

As illustrated in FIG. 13, when the inlet 35 overlaps the mounting portion 118 in the vertical direction, the opening/closing inhibiting portion 24 inhibits opening and closing of the lid member 36. In this embodiment, when the inlet positions 35*c*, 35*d*, and 35*e* overlap the mounting portion 118 in the vertical direction, the opening/closing inhibiting portion 24 inhibits opening and closing of all the lid members 36. That is, when the first to third inlets from the home position HP side overlap the mounting portion 118 in the vertical direction, the opening/closing inhibiting portion 24 inhibits opening and closing of all the lid members 36.

According to the second embodiment, the same operation and the same effects (1) to (8) as in the first embodiment can be obtained.

Third Embodiment

Figure 15:
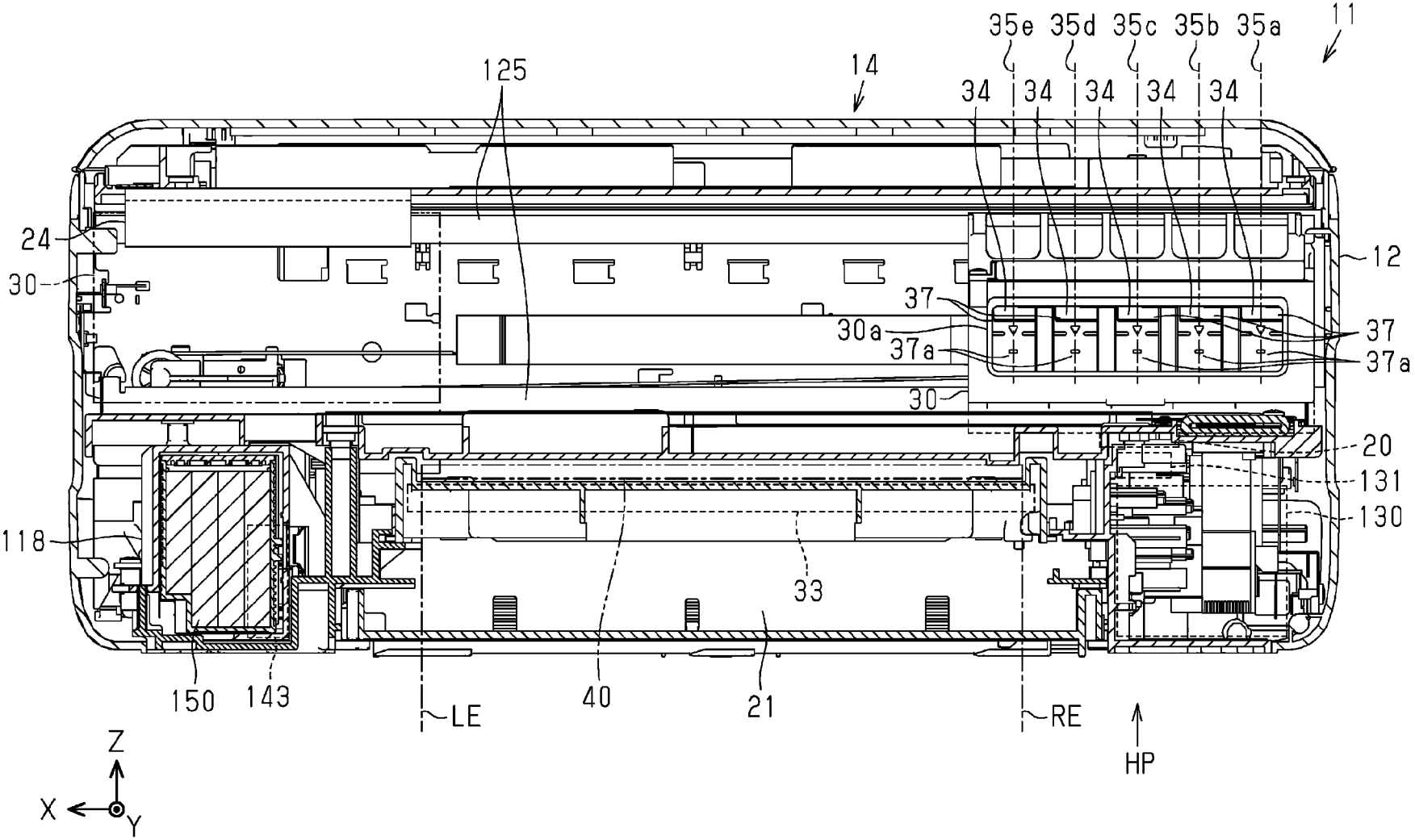
FIG. 15 is a front cross-sectional view illustrating a liquid ejection apparatus when a carriage is at a home position in a third embodiment.

Next, a third embodiment of the liquid ejection apparatus will be described with reference to FIGS. 15 and 16. As illustrated in FIG. 15, the third embodiment is different from the first embodiment in that the mounting portion 118 is disposed on the left (+X side of the left end LE of the transport path 40) outside of the transport path 40 in the scanning direction. The other points are substantially the same as those of the first embodiment, and thus the same configurations are denoted by the same reference numerals and the duplicate description will be omitted.

As illustrated in FIG. 15, when the liquid ejection head 20 moves to the opposite home position side, the liquid ejection head 20 is outside the opposite home position side of the transport path 40 in the scanning direction, and the carriage 30 is disposed at a position that overlaps the mounting portion 118 in the vertical direction.

As illustrated in FIG. 9, the waste liquid container 150 that contains liquid as waste liquid discharged from the liquid ejection head 20 is detachably mounted to the mounting portion 118 from the apparatus front side, which is downstream in the transport direction of the casing 12. However, the mounting portion 118 is on the right outside of the transport path 40 in the scanning direction in the first embodiment (see FIG. 9), whereas the mounting portion 118 is on the left outside of the transport path 40 in the scanning direction in the third embodiment, and thus the left and right of the mounting portion 118 in FIG. 9 are inverted in FIG. 15 of the third embodiment. Similarly, the left and right of the waste liquid container 150 of FIG. 10 are inverted in FIG. 15 of the third embodiment.

As illustrated in FIG. 3, the inlet 35 is provided on a downstream region in the transport direction in the casing 12. As illustrated in FIG. 15, when the liquid ejection head 20 is outside the transport path 40 in the scanning direction (when the carriage 30 is at the position indicated by the two-dot chain line in FIG. 15), the inlet 35 is disposed at a position that overlaps the mounting portion 118 in the vertical direction.

Figure 16:
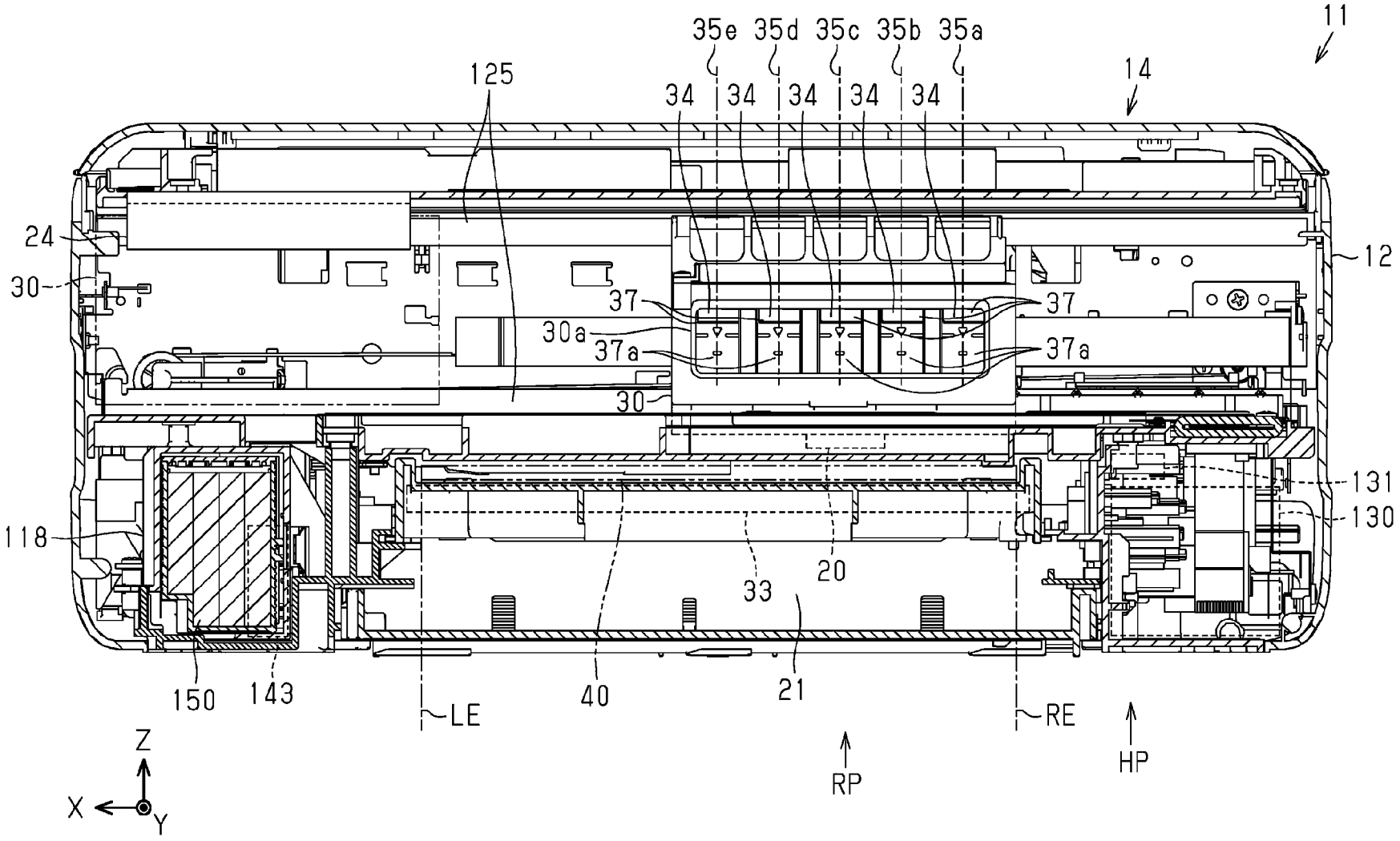
FIG. 16 is a front cross-sectional view illustrating the liquid ejection apparatus when the carriage is at an ink pouring position.

As illustrated in FIG. 16, when pouring liquid from the inlet 35 (not illustrated), the carriage 30 moves to the pouring position RP where the inlet 35 and the mounting portion 118 do not overlap in the vertical direction. In FIG. 16, the positions on the X-axis of the five inlets 35 are illustrated as the inlet positions 35*a*, 35*b*, 35*c*, 35*d*, and 35*e* from the home position HP side. In this embodiment, the carriage 30 moves to the pouring position RP where the inlet positions 35*a*, 35*b*, 35*c*, 35*d*, and 35*e* do not overlap the mounting portion 118 in the vertical direction. That is, the carriage 30 moves to the pouring position RP where all the inlets 35 do not overlap the mounting portion 118 in the vertical direction.

As illustrated in FIG. 16, a plurality of liquid containers 34 are loaded on the carriage 30, and when pouring liquid from one inlet 35, the carriage 30 may move to the pouring position RP where the one inlet 35 and the mounting portion 118 do not overlap in the vertical direction.

As illustrated in FIGS. 9 and 10, the mounting portion 118 (see FIG. 9) includes the substrate coupling portion 143 (see FIG. 9) that is electrically coupled to the circuit substrate 156 (see FIG. 11) provided in the waste liquid container 150 (see FIG. 10). However, the mounting portion 118 is on the right outside of the transport path 40 in the scanning direction in the first embodiment (see FIG. 9), whereas the mounting portion 118 is on the left outside of the transport path 40 in the scanning direction in the third embodiment, and thus the left and right of the mounting portion 118 in FIG. 9 are inverted in FIG. 16 of the third embodiment. Similarly, the left and right of the waste liquid container 150 of FIG. 10 are inverted in FIG. 16 of the third embodiment.

As illustrated in FIG. 16, the pouring position RP is a position where the carriage 30 does not overlap the substrate coupling portion 143 (see FIG. 9) in the vertical direction. The pouring position RP is a position where the carriage 30 does not overlap the mounting portion 118 in the vertical direction.

As illustrated in FIG. 15, when the inlet 35 overlaps the mounting portion 118 in the vertical direction, the opening/closing inhibiting portion 24 inhibits opening and closing of the lid member 36. In this embodiment, when the inlet positions 35*c*, 35*d*, and 35*e* overlap the mounting portion 118 in the vertical direction, the opening/closing inhibiting portion 24 inhibits opening and closing of all the lid members 36. That is, when the first to third inlets from the opposite home position side overlap the mounting portion 118 in the vertical direction, the opening/closing inhibiting portion 24 inhibits opening and closing of all the lid members 36.

According to the third embodiment, the same operation and the same effects (1) to (8) as in the first embodiment can be obtained.

Fourth Embodiment

Figure 17:
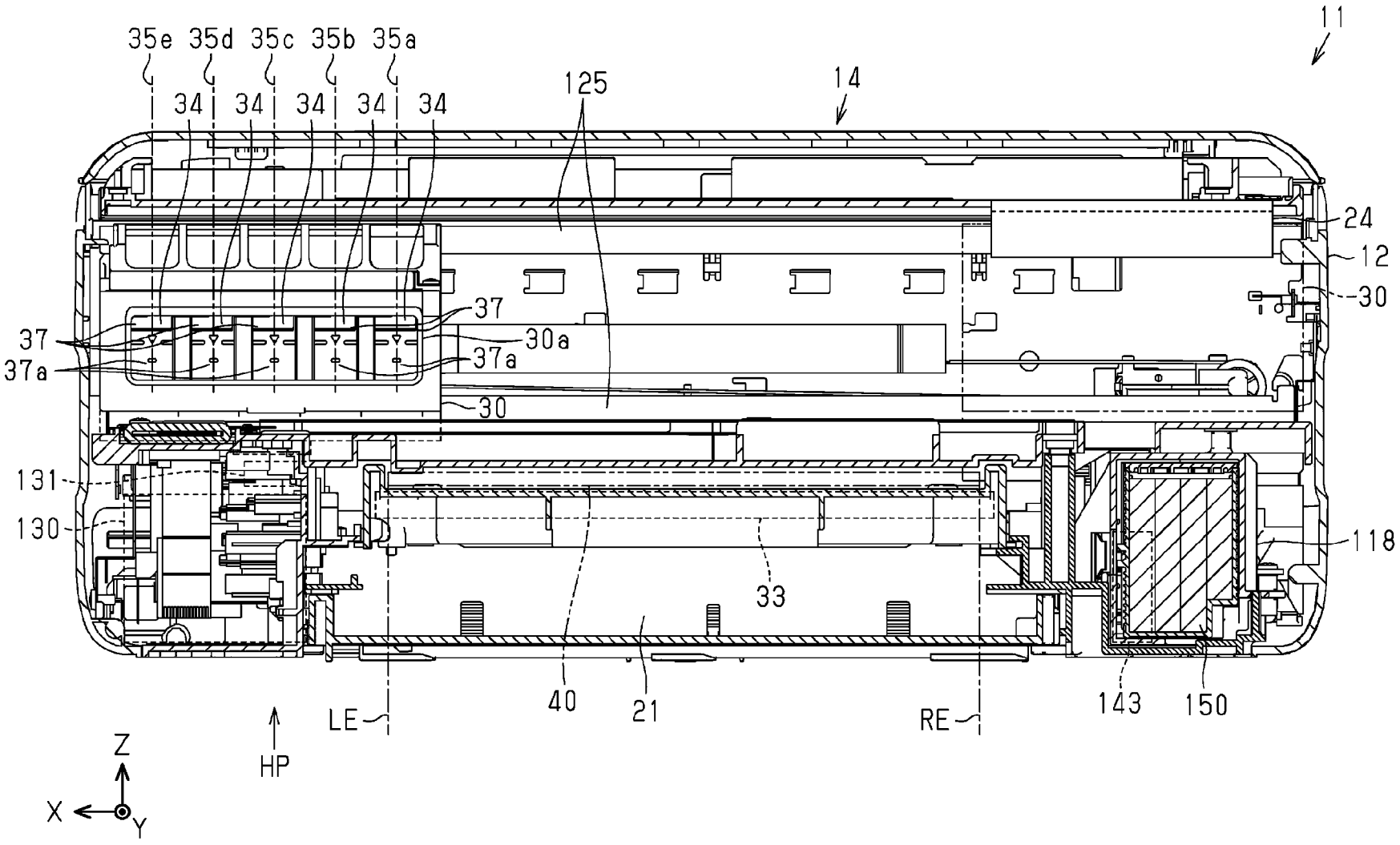
FIG. 17 is a front cross-sectional view illustrating a liquid ejection apparatus when a carriage is at a home position in a fourth embodiment.

Next, a fourth embodiment of the liquid ejection apparatus will be described with reference to FIGS. 17 and 18. As illustrated in FIG. 17, the fourth embodiment is different from the first embodiment in that the home position HP is at a position opposite to the home position HP (see FIG. 4) in the first embodiment in the width direction. The other points are substantially the same as those of the first embodiment, and thus the same configurations are denoted by the same reference numerals, and the duplicate description will be omitted.

As illustrated in FIG. 17, when the liquid ejection head 20 moves to the opposite home position side, the liquid ejection head 20 is outside the opposite home position side of the transport path 40 in the scanning direction, and the carriage 30 is disposed at a position that overlaps the mounting portion 118 in the vertical direction.

As illustrated in FIG. 9, the waste liquid container 150 that contains liquid as waste liquid discharged from the liquid ejection head 20 is detachably mounted to the mounting portion 118 from the apparatus front side, which is downstream in the transport direction of the casing 12.

As illustrated in FIG. 3, the inlet 35 is provided downstream in the transport direction in the casing 12. As illustrated in FIG. 17, when the liquid ejection head 20 is outside the transport path 40 in the scanning direction, that is, when the carriage 30 is at the position indicated by the two-dot chain line in FIG. 17, the inlet 35 is disposed at a position that overlaps the mounting portion 118 in the vertical direction.

Figure 18:
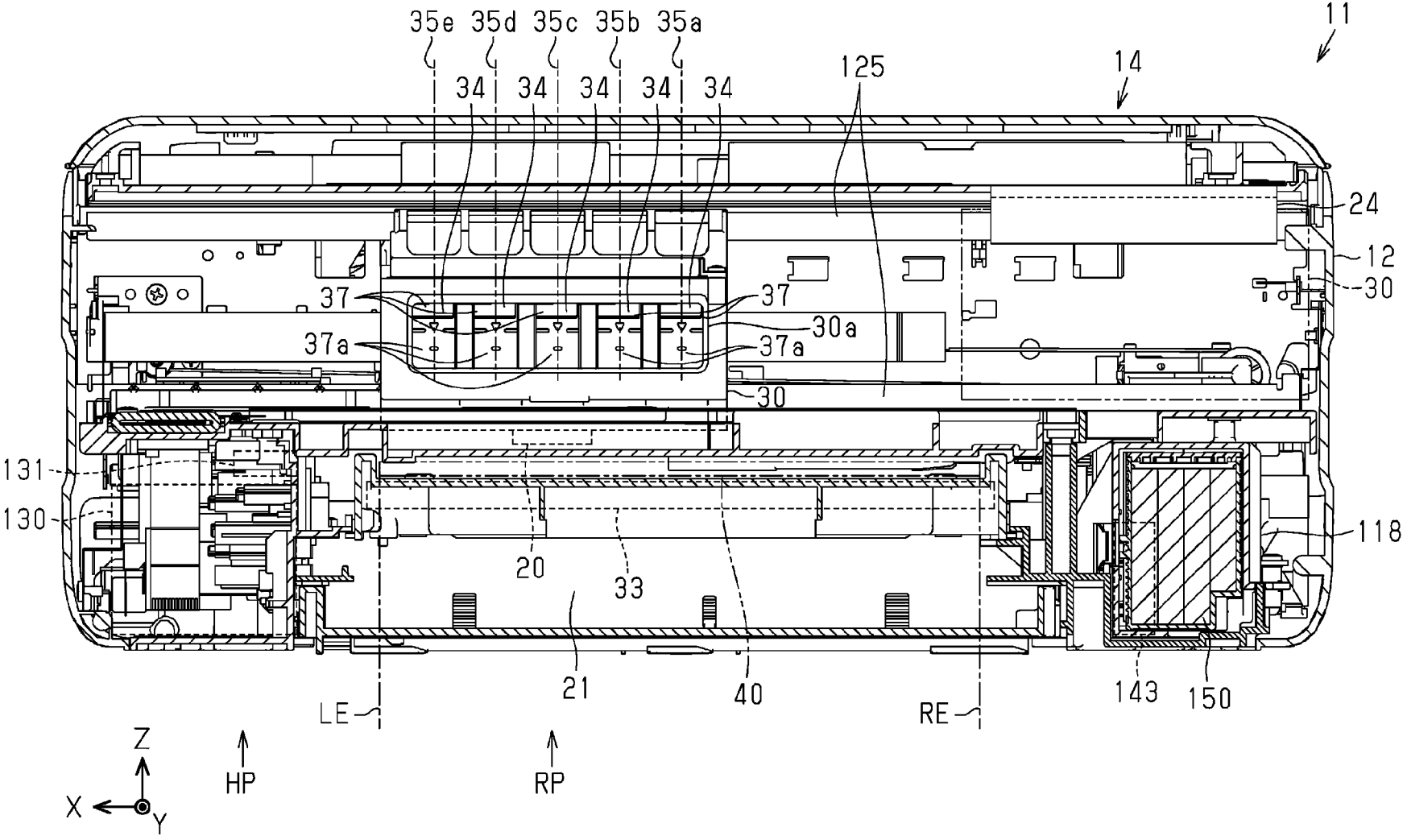
FIG. 18 is a front cross-sectional view illustrating the liquid ejection apparatus when the carriage is at an ink pouring position.

As illustrated in FIG. 18, when pouring liquid from the inlet 35, the carriage 30 moves to the pouring position RP where the one inlet 35 and the mounting portion 118 do not overlap in the vertical direction. In FIG. 18, the positions on the X-axis of the five inlets 35 are illustrated as the inlet positions 35*a*, 35*b*, 35*c*, 35*d*, and 35*e* from the home position HP side. In this embodiment, the carriage 30 moves to the pouring position RP where the inlet positions 35*a*, 35*b*, 35*c*, 35*d*, and 35*e* do not overlap the mounting portion 118 in the vertical direction. That is, the carriage 30 moves to the pouring position RP where all the inlets 35 do not overlap the mounting portion 118 in the vertical direction.

As illustrated in FIG. 18, a plurality of liquid containers 34 are loaded on the carriage 30, and when pouring liquid from one inlet 35, the carriage 30 may move to the pouring position RP where the one inlet 35 and the mounting portion 118 do not overlap in the vertical direction.

As illustrated in FIGS. 9 and 10, the mounting portion 118 (see FIG. 9) includes the substrate coupling portion 143 (see FIG. 9) that is electrically coupled to the circuit substrate 156 (see FIG. 11) provided in the waste liquid container 150 (see FIG. 10).

As illustrated in FIG. 18, the pouring position RP is at a position where the carriage 30 does not overlap the substrate coupling portion 143 in the vertical direction (see FIG. 9). The pouring position RP is a position where the carriage 30 does not overlap the mounting portion 118 in the vertical direction.

As illustrated in FIG. 17, when the inlet 35 overlaps the mounting portion 118 in the vertical direction, the opening/closing inhibiting portion 24 inhibits opening and closing of the lid member 36. In this embodiment, when the inlet positions 35*a*, 35*b*, and 35*c* overlap the mounting portion 118 in the vertical direction, the opening/closing inhibiting portion 24 inhibits opening and closing of all the lid members 36. That is, when the first to third inlets from the opposite home position side overlap the mounting portion 118 in the vertical direction, the opening/closing inhibiting portion 24 inhibits opening and closing of all the lid members 36.

According to the fourth embodiment, the same operation and the same effects (1) to (8) as in the first embodiment can be obtained.

The embodiments described above can be modified to a form such as the following modification examples. Furthermore, a combination of the embodiments described above and the following modification examples may also be a further modification example, or a combination of the following modification examples may also be a further modification example.

In the first embodiment, in addition to the cap 131 included in the maintenance mechanism 130, another cap may be provided on the left outside of the transport path 40, and the position of the cap may be set as the home position HP of the liquid ejection head 20. The cap is also configured to be movable between an open position separated from the liquid ejection head 20 and a capping position surrounding the nozzle 120 and contacting the liquid ejection head 20 by the urging force of the urging member 136. The purpose of the cap is to prevent the nozzle from drying. The liquid ejection head 20 is periodically moved to the right side of the apparatus outside the transport path 40 in the scanning direction, which is the position of the cap 131 included in the maintenance mechanism 130, and cleaning is performed.

In the second embodiment, in addition to the cap 131 included in the maintenance mechanism 130, another cap may be provided on the right outside of the transport path 40, and the position of the cap may be set as the home position HP of the liquid ejection head 20. The cap is also configured to be movable between the open position separated from the liquid ejection head 20 and the capping position surrounding the nozzle 120 and contacting the liquid ejection head 20 by the urging force of the urging member 136. The purpose of the cap is to prevent the nozzle from drying. The liquid ejection head 20 is periodically moved to the left outside of the transport path 40, which is the position of the cap 131 included in the maintenance mechanism 130, and cleaning is performed.

If the waste liquid container 150 is detachably mounted to the mounting portion 118, the mounting portion 118 does not need to be box-shaped. The surface of the mounting portion 118 corresponding to the case lid 152 of the waste liquid container 150 may not be provided, or the surface of the mounting portion 118 corresponding to the first side surface 155F or the second side surface 155S may not be provided.

The inlets 35 does not need to be aligned in the scanning direction. The inlets 35 may be disposed by being shifted in the transport direction or may be alternately disposed. The liquid containers 34 may be disposed side by side in the transport direction and the inlets 35 may be aligned in the transport direction. The inlets 35 do not need to be aligned in the transport direction, may be disposed by being shifted in the scanning direction, or may be alternately disposed.

All the liquid containers 34 do not need to have the same size. The size of the liquid container 34 may be increased by increasing the length of the liquid container for the liquid, of which use amount is large, in the scanning direction. The size of the liquid container 34 may be changed by increasing the length of the liquid container for the liquid, of which use amount is large, in the transport direction. The size of the liquid container for the liquid of which use amount is small may be reduced. By changing the size of the liquid container 34, the pitch of the inlet 35 in the scanning direction may be changed, or the pitch may not be constant.

In the first embodiment, the waste liquid container 150 may be detachably mounted from the right side surface of the apparatus on the home position HP side.

In the second embodiment, the waste liquid container 150 may be detachably mounted from the left side surface of the apparatus on the home position HP side.

In the third embodiment, the waste liquid container 150 may be detachably mounted from the left side surface of the apparatus on the opposite home position side.

In the fourth embodiment, the waste liquid container 150 may be detachably mounted from the right side surface of the apparatus on the opposite home position side.

The user inserts a supply port portion of the liquid replenishing container into the inlet 35 and pours the liquid in the liquid replenishing container into the containing chamber 37. If the inlet 35 is provided on the front side than a half position in the transport direction of the liquid ejection apparatus 11, when the liquid in the liquid replenishing container is poured into the containing chamber 37, there is little possibility that the liquid replenishing container hits the scanner unit 14 or the panel unit 23. Even if the liquid replenishing container hits the unit, the liquid in the liquid replenishing container can be poured into the containing chamber 37 only by slightly inclining the liquid replenishing container, and thus there is little possibility of spilling ink. The inlet 35 may be positioned anywhere in the liquid container 34 as long as it is provided downstream in the transport direction of the liquid ejection apparatus 11. Further, as long as the ink pouring work is not hindered, the inlet 35 is not limited to downstream in the transport direction of the liquid ejection apparatus 11, and may be on the front side or the rear side of the liquid container 34.

As illustrated in FIGS. 5, 14, 16, and 18, the pouring position RP of the carriage 30 when pouring the liquid from the inlet 35 may be anywhere as long as the inlet 35 and the mounting portion 118 do not overlap in the vertical direction. The pouring position RP may be positioned closer to the opposite home position side than the positions illustrated in the figures, or may be positioned closer to the home position HP side than the positions illustrated in the figures.

As illustrated in FIGS. 5, 14, 16, and 18, when a plurality of liquid containers 34 are loaded on the carriage 30, the pouring position RP of the carriage 30 when the liquid is poured from one inlet 35 may be anywhere as long as the one inlet 35 and the mounting portion 118 do not overlap in the vertical direction. The pouring position RP may be positioned closer to the opposite home position side than the positions illustrated in the figures, or may be positioned closer to the home position HP side than the positions illustrated in the figures. When a plurality of liquid containers 34 are loaded on the carriage 30 and liquid is poured from one inlet 35, the carriage 30 may move to the pouring position where the one inlet 35 and the mounting portion 118 do not overlap in the vertical direction. At the pouring position RP, if the one inlet 35 for pouring the liquid and the mounting portion 118 do not overlap in the vertical direction, at least one of the other inlets 35 into which the liquid is not poured may overlap the mounting portion 118 in the vertical direction.

As illustrated in FIGS. 5, 14, 16, and 18, the pouring position RP of the carriage 30 when the liquid is poured from the inlet 35 may be anywhere as long as the carriage 30 and the substrate coupling portion 143 do not overlap in the vertical direction. The pouring position RP may be positioned closer to the opposite home position side than the positions illustrated in the figures, or may be positioned closer to the home position HP side than the positions illustrated in the figures.

As illustrated in FIGS. 5, 14, 16, and 18, the pouring position RP of the carriage 30 when the liquid is poured from the inlet 35 may be anywhere as long as the carriage 30 and the mounting portion 118 do not overlap in the vertical direction. The pouring position RP may be positioned closer to the opposite home position side than the positions illustrated in the figures, or may be positioned closer to the home position HP side than the positions illustrated in the figures.

When an abnormal load occurs on a sliding portion due to foreign matter adhering to the guide plate 125 or the like, or when an unexpected power interruption such as a power failure occurs, the carriage 30 may stop at a place other than the home position HP or the pouring position RP. At this time, when the user opens the scanner unit 14, the user can open the lid member 36 even though the carriage 30 is stopped at a place other than the pouring position RP. For that reason, when the carriage 30 is stopped at the place other than the pouring position RP, a plurality of opening/closing inhibiting portions 24 may be provided at positions where the user cannot open the lid member 36.

The opening/closing inhibiting portion 24 may be disposed so that the user can open only one lid member 36 by providing an opening that is larger than the length of one lid member 36 in the scanning direction and smaller than the length of two lid members 36 in the scanning direction. For example, a liquid residual amount sensor detects a color of ink to be poured and the carriage 30 is moved to a position where the ink lid member 36 is opened. At this time, the length of the notch 25 in the scanning direction may be shortened so that the user may visually recognize only the remaining amount checking section 37*a* for the ink. At this time, since the user pours the ink into the inlet 35 in which the remaining amount checking section 37*a* can be visually recognized, there is little possibility that the color of the ink to be poured is wrong.

The length of the opening/closing inhibiting portion 24 in the scanning direction may be short. For example, the length of the opening/closing inhibiting portion 24 may be short when the number of the inlets 35 is small, when the length of the carriage 30 in the width direction is short, when the length of the mounting portion 118 in the width direction is short, when the length of the waste liquid container 150 in the width direction is short, and the like. In the case where the number of the inlets 35 is one, when the inlet 35 overlaps the mounting portion 118 in the vertical direction, the opening/closing inhibiting portion 24 only needs to have a length capable of inhibiting opening and closing of the lid member 36 corresponding to the inlet 35. When there are a plurality of inlets 35, when the carriage 30 moves to the pouring position RP, the opening/closing inhibiting portion 24 only needs to have a length capable of inhibiting opening and closing of the lid member 36 corresponding to the inlet 35 which is at a position that overlaps the mounting portion 118 in the vertical direction.

A window through which the user visually recognizes the remaining amount checking section 37*a* may be provided on the panel unit 23 or the front surface 12*a* of the casing 12 so that the user can visually recognize the remaining amount checking section 37*a* without opening the scanner unit 14. A window through which the user visually recognizes the remaining amount checking section 37*a* may be provided on the panel unit 23 or the front surface 12*a* of the casing 12 so that the user can visually recognize the remaining amount checking section 37*a* without moving the carriage 30 to the pouring position RP.

In the remaining amount checking section 37*a*, a light for irradiating light from the depth side of the apparatus may be provided in the liquid container 34 so that the liquid level is easily seen when the user checks the remaining amount of the liquid, a window through which light enters the liquid container 34 may be provided on the side surface of the carriage 30 or the side surface of the casing 12, or a place where a user can illuminate so that the inside of the liquid container 34 can be seen may be provided.

The lid member 36 that can open and close the inlet 35 may be coupled to the carriage 30 or the liquid container 34. The lid member 36 has a function of opening and closing, and may be provided as a single unit. The method of opening and closing is not limited, and a lever method as in the embodiments or a rubber stopper may be used. The opening and closing method may be any as long as it can be opened and closed by the user.

In the third embodiment, the maintenance mechanism 130 may be outside the home position HP side of the transport path 40, or may be outside the opposite home position side of the transport path 40. When the maintenance mechanism 130 is outside the home position HP side of the transport path 40, the discharge tube 135 passes through the depth side of the liquid ejection apparatus 11 and crosses the transport path 40 in the scanning direction.

In the fourth embodiment, the maintenance mechanism 130 may be outside the home position HP side of the transport path 40 in the scanning direction, or may be outside the opposite home position side of the transport path 40 in the scanning direction. When the maintenance mechanism 130 is outside the opposite home position side of the transport path 40 in the scanning direction, the discharge tube 135 passes through the depth side of the liquid ejection apparatus 11 and crosses the transport path 40 in the scanning direction.

When the liquid ejection head 20 is positioned outside the transport path 40 in the scanning direction, if the liquid ejection head 20 is at a position that overlaps the carriage 30 in the vertical direction, the mounting portion 118 may be disposed above the carriage 30 in the vertical direction. As long as a configuration in which the accommodation space can be secured at a position above the carriage 30 in the casing 12 is adopted, the mounting portion 118 can be disposed above the carriage 30 when the mounting portion 118 is at the home position HP. In this case, the mounting portion 118 may have a configuration in which the waste liquid container 150 is detachably mounted from the front of the liquid ejection apparatus 11, or may have a configuration in which the waste liquid container 150 is detachably inserted in a height direction from a position downstream in the transport direction on the upper surface of the liquid ejection apparatus 11.

In each embodiment described above, the configuration in which the width dimension of the carriage 30 is larger than the width dimension of the mounting portion 118, the entire area in the width direction of the mounting portion 118 overlaps the carriage 30 in the vertical direction, and a part in the width direction of the carriage 30 overlaps the mounting portion 118 in the vertical direction, but is not limited thereto. A configuration in which the width dimension of the mounting portion 118 is made larger than the width dimension of the carriage 30, a part of the mounting portion 118 overlaps the carriage 30 in the vertical direction, and the entire area in the width direction of the carriage 30 overlaps the mounting portion 118 in the vertical direction.

Furthermore, the mounting portion 118 and the carriage 30 may be configured to have the same width, the mounting portion 118 and the carriage 30 may be configured to overlap each other in the vertical direction in the entire region, or may be configured to partially overlap each other.

It is sufficient that the mounting portion 118 and the carriage 30 partially overlap in the vertical direction. For example, the outer end of the mounting portion 118 may be positioned outside the outer end of the carriage 30 when positioned at the home position HP in the scanning direction.

One mounting portion 118 may be provided on each of both sides of the transport path 40 in the scanning direction. In this case, the two mounting portions 118 may overlap the carriage 30 in the vertical direction when positioned at the home position HP or the carriage 30 when positioned at the opposite home position, respectively. A configuration in which only one of the two mounting portions 118 overlaps the carriage 30 in the vertical direction when positioned at the home position HP or the opposite home position may be adopted. The attachment and detachment of the waste liquid containing bodies 150 with respect to the two mounting portions 118 may be performed from the front surface of the casing 12 or from the side surface of the casing 12. The attachment and detachment with respect to one mounting portion 118 may be performed from the front surface of the casing 12 and the attachment and detachment with respect to the other mounting portion 118 may be performed from the side surface of the casing 12. Furthermore, the sizes of the waste liquid containing bodies 150 detachably mounted to the two mounting portions 118 may be the same or different.

When the liquid is poured from the inlet 35, if the inlet 35 and the mounting portion 118 do not overlap in the vertical direction, the carriage 30 may partially overlap the mounting portion 118 in the vertical direction.

The mounting portion 118 and the maintenance mechanism 130 may be disposed so as to overlap in the scanning direction. For example, the mounting portion 118 and the maintenance mechanism 130 may be disposed side by side in the width direction.

The mounting portion 118 may be disposed at a position upstream of the maintenance mechanism 130 in the transport direction.

When the liquid ejection head 20 is outside the transport path 40 in the scanning direction, if the carriage 30 is disposed at a position that overlaps the mounting portion 118 in the vertical direction, a part of the mounting portion 118 may be disposed below the transport path 40. For example, if the configuration does not include the medium tray 21, a part of the waste liquid container 150 can be disposed below the medium support member 33.

The liquid ejection apparatus 11 may be a liquid ejection apparatus that ejects liquid other than ink. The state of the liquid ejected as a minute amount of liquid droplets from the liquid ejection apparatus includes a state that leaves a tail in a granular shape, a tear shape, or a thread shape. The liquid here may be any material that can be ejected from the liquid ejection apparatus. For example, it is sufficient that the liquid is in a state when a substance is in a liquid phase, and includes fluids such as liquid material having high or low viscosity, sol, gel water, other inorganic solvents, organic solvents, solutions, liquid resins, liquid metals, and metal melts. The liquid includes not only liquid as one state of a substance but also liquid in which particles of a functional material formed of a solid such as a pigment or metal particles are dissolved, dispersed, or mixed in a solvent. Representative examples of the liquid include ink and liquid crystal as described in the embodiments described above. Here, the ink includes general water-based ink and oil-based ink, and various liquid compositions such as gel ink and hot melt ink. As a specific example of the liquid ejection apparatus, for example, there is an apparatus for ejecting liquid containing a material such as an electrode material and a coloring material used for manufacturing a liquid crystal display, an electroluminescence display, a surface-emitting display, a color filter, and the like in a dispersed or dissolved form. The liquid ejection apparatus may be an apparatus for ejecting a biological organic substance used for manufacturing a biochip, an apparatus that is used as a precision pipette and ejects liquid serving as a sample, a printing apparatus, a micro-dispenser, and the like. The liquid ejection apparatus may be an apparatus for ejecting lubricating oil to precision machines such as watches and cameras in a pinpoint manner or an apparatus for ejecting transparent resin liquid such as an ultraviolet curable resin onto a substrate to form a micro hemispherical lens, an optical lens, and the like used for an optical communication element. The liquid ejection apparatus may be an apparatus for ejecting etchant such as an acid or an alkali for etching a substrate or the like.

In the following, technical ideas and operational effects grasped from the embodiments and modification examples described above will be described.

A. A liquid ejection apparatus includes a liquid ejection head that ejects liquid to a medium transported in a transport direction on a transport path, a liquid container that includes a containing chamber for containing liquid to be supplied to the liquid ejection head and an inlet for pouring the liquid into the containing chamber, a carriage movable in a scanning direction that intersects the transport direction in a state where the liquid ejection head and the liquid container are loaded on the carriage, and a mounting portion on which a waste liquid container that contains liquid as waste liquid discharged from the liquid ejection head is detachably mounted, and the mounting portion is provided in a region on a front side in the transport direction of the liquid ejection apparatus, and when the liquid ejection head is located outside the transport path in the scanning direction, the carriage is disposed at a position that overlaps the mounting portion in the vertical direction. The expression "overlapping the mounting portion in the vertical direction" includes a case where the carriage overlaps the entire mounting portion and a case where the carriage overlaps only a part of the mounting portion.

According to this configuration, even in the configuration in which the waste liquid container is mounted, when the liquid ejection head is outside the transport path, the carriage overlaps the mounting portion in the vertical direction, and thus the mounting area of the liquid ejection apparatus does not increase as compared with a liquid ejection apparatus having a configuration in which the carriage and the mounting portion do not overlap. The waste liquid container is detachably mounted to the mounting portion downstream in the transport direction of the casing, and thus operability when attaching and detaching the waste liquid container is good. Therefore, the operability when attaching and detaching the waste liquid container is good, and the increase in the mounting area of the liquid ejection apparatus can be suppressed.

B. In the liquid ejection apparatus, the mounting portion may be configured to attach and detach the waste liquid container to and from a region on the front side in the transport direction of the liquid ejection apparatus.

According to this configuration, a space for mounting the medium discharged from the transport path is secured downstream in the transport direction of the casing, and a new work space for removing the waste liquid container is not required. Therefore, the mounting area of the liquid ejection apparatus does not need to be large, and an occupied space including a working space of the liquid ejection apparatus does not need to be large.

C. In the liquid ejection apparatus, the inlet may be provided in a region on the front side in the transport direction of the liquid ejection apparatus, and when the liquid ejection head is located outside the transport path in the scanning direction, the inlet may be disposed at a position that overlaps the mounting portion in the vertical direction.

According to this configuration, the user can perform both the operation of pouring liquid from the inlet and the operation of attaching and detaching the waste liquid container to and from the mounting portion from the front of the apparatus, thereby improving workability of the user. Both operations can be performed from the front of the apparatus, the degree of freedom in installing the apparatus is increased.

D. In the liquid ejection apparatus, when the liquid is poured from the inlet, the carriage may move to a pouring position where the inlet and the mounting portion do not overlap in the vertical direction.

According to this configuration, it is possible to suppress that liquid dripping at the time of pouring adheres to the waste liquid container.

E. In the liquid ejection apparatus, the carriage may be loaded with a plurality of the liquid containers, and when liquid is poured from one inlet, the carriage may move to a pouring position where the one inlet and the mounting portion do not overlap in the vertical direction.

According to this configuration, it is possible to suppress that liquid dripping at the time of pouring adheres to the waste liquid container.

F. In the liquid ejection apparatus, the mounting portion may include a substrate coupling portion electrically coupled to a circuit substrate provided in the waste liquid container, and the pouring position may be a position where the carriage does not overlap the substrate coupling portion in the vertical direction.

According to this configuration, it is possible to suppress that liquid dripping at the time of pouring adheres to the substrate coupling portion.

G. In the liquid ejection apparatus, the pouring position may be a position where the carriage does not overlap the mounting portion in the vertical direction.

According to this configuration, it is possible to suppress that liquid dripping at the time of pouring adheres to the mounting portion. It is possible to suppress that liquid dripping at the time of pouring adheres to the waste liquid container.

H. The liquid ejection apparatus may further include a lid member that opens and closes the inlet and an opening/closing inhibiting portion that inhibits opening and closing of the lid member when the inlet overlaps the mounting portion in the vertical direction.

According to this configuration, the user is prevented from pouring the liquid at a position where liquid dripping at the time of the pouring may adhere to the waste liquid container.

What is claimed is:

1. A liquid ejection apparatus comprising:

a liquid ejection head that ejects liquid to a medium transported in a transport direction on a transport path;

a liquid container that includes a containing chamber for containing liquid to be supplied to the liquid ejection head and an inlet for pouring the liquid into the containing chamber;

a carriage movable in a scanning direction that intersects the transport direction in a state where the liquid ejection head and the liquid container are loaded on the carriage; and a mounting portion on which a waste liquid container that contains liquid as waste liquid discharged from the liquid ejection head is detachably mounted, wherein the mounting portion and the inlet are provided in a region on a front side in the transport direction of the liquid ejection apparatus, and when the liquid ejection head is located outside the transport path in the scanning direction, the carriage and the inlet are disposed at a position that overlaps the mounting portion in a vertical direction.

2. The liquid ejection apparatus according to claim 1, wherein the mounting portion is configured to attach and detach the waste liquid container to and from a region on the front side in the transport direction of the liquid ejection apparatus.

3. The liquid ejection apparatus according to claim 1, further comprising:

a lid member configured to open and close the inlet; and an opening/closing inhibiting portion that inhibits opening and closing of the lid member when the inlet overlaps the mounting portion in the vertical direction.

4. A liquid ejection apparatus comprising:

a liquid ejection head that ejects liquid to a medium transported in a transport direction on a transport path;

a liquid container that includes a containing chamber for containing liquid to be supplied to the liquid ejection head and an inlet for pouring the liquid into the containing chamber;

a carriage movable in a scanning direction that intersects the transport direction in a state where the liquid ejection head and the liquid container are loaded on the carriage; and a mounting portion on which a waste liquid container that contains liquid as waste liquid discharged from the liquid ejection head is detachably mounted, wherein the mounting portion is provided in a region on a front side in the transport direction of the liquid ejection apparatus, when the liquid ejection head is located outside the transport path in the scanning direction, the carriage is disposed at a position that overlaps the mounting portion in a vertical direction, and when liquid is poured from the inlet, the carriage moves to a pouring position where the inlet and the mounting portion do not overlap in the vertical direction.

5. A liquid ejection apparatus comprising:

a liquid ejection head that ejects liquid to a medium transported in a transport direction on a transport path;

a liquid container that includes a containing chamber for containing liquid to be supplied to the liquid ejection head and an inlet for pouring the liquid into the containing chamber;

a carriage movable in a scanning direction that intersects the transport direction in a state where the liquid ejection head and the liquid container are loaded on the carriage; and a mounting portion on which a waste liquid container that contains liquid as waste liquid discharged from the liquid ejection head is detachably mounted, wherein the mounting portion is provided in a region on a front side in the transport direction of the liquid ejection apparatus, when the liquid ejection head is located outside the transport path in the scanning direction, the carriage is disposed at a position that overlaps the mounting portion in a vertical direction, the carriage is loaded with a plurality of the liquid containers, and when liquid is poured from one inlet, the carriage moves to a pouring position where the one inlet and the mounting portion do not overlap in the vertical direction.

6. The liquid ejection apparatus according to claim 5, wherein the mounting portion includes a substrate coupling portion electrically coupled to a circuit substrate provided in the waste liquid container, and the pouring position is a position where the carriage does not overlap the substrate coupling portion in the vertical direction.

7. The liquid ejection apparatus according to claim 5, wherein the pouring position is a position where the carriage does not overlap the mounting portion in the vertical direction.

* * * * *